United States Patent [19]

Kenneday et al.

[11] 4,096,913

[45] Jun. 27, 1978

[54] HYDRAULICALLY SET LINER HANGER AND RUNNING TOOL WITH BACKUP MECHANICAL SETTING MEANS

[75] Inventors: John W. Kenneday; Charles W. Kinney; Floyd L. Scott, Jr., all of Houston, Tex.; Phillip W. Schmuck, New Orleans, La.

[73] Assignee: Baker International Corporation, Orange, Calif.

[21] Appl. No.: 826,284

[22] Filed: Aug. 22, 1977

Related U.S. Application Data

[63] Continuation-in-part of Ser. No. 758,359, Jan. 10, 1977, Pat. No. 4,060,131.

[51] Int. Cl.[2] ..... E21B 43/10; E21B 23/00

[52] U.S. Cl. ..... 166/290; 166/120; 166/208; 166/315

[58] Field of Search ..... 166/290, 315, 120, 208, 166/212, 240

[56] References Cited

U.S. PATENT DOCUMENTS

| | | | |
|---|---|---|---|
| 2,318,167 | 5/1943 | Knowlton | 166/208 |
| 3,223,170 | 12/1965 | Mott | 166/212 |
| 3,291,220 | 12/1966 | Mott | 166/208 |
| 3,608,634 | 9/1971 | Cochran | 166/208 |
| 3,934,652 | 1/1976 | Cochran | 166/208 |
| 4,060,131 | 11/1977 | Kenneday et al. | 166/315 |

*Primary Examiner*—James A. Leppink
*Attorney, Agent, or Firm*—William C. Norvell, Jr.

[57] ABSTRACT

Apparatus is provided for running, setting and anchoring a liner in a well bore casing, comprising inner and outer bodies with expander and gripping means carried on the bodies to provide means for gripping engagement with casing. A running tool is secured to the bodies and defines drag means thereon to resist longitudinal travel while the apparatus is being mechanically set. A piston element is carried on the running tool and is responsive to fluid pressure entrappable in a piston pressure chamber to hydraulically set the hanger. Mechanical setting means are provided and may be activated to set the hanger upon failure of the hydraulic activation means.

38 Claims, 42 Drawing Figures

280
200
RT
100
300
P301
400
C
H
400
500
608
600
620
700
W
1041
FS
280
104
206
202
399
220
398
307
404
P102
412
421
424
800
806
907
909a
813
820
916
812a
829
841
920
1045
P301
408
801
906
504
626
812
719
900
723
731
1031
1041
1040
1041
1202

200
399
RT
398
100
300
C
P301
400
H
500
600
1000
700
W
FS
420
508
608
424
626
900
909a
813
736
1045
800
812
820
812a
916
829
841
1000
1040
1202

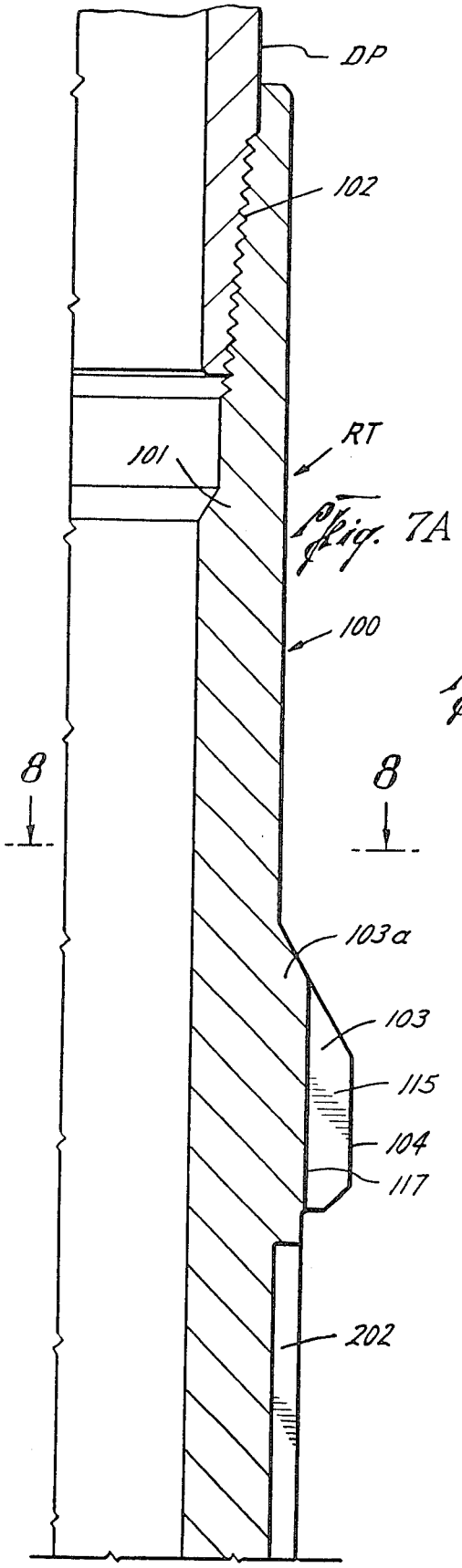
Fig. 7A
Fig. 7B
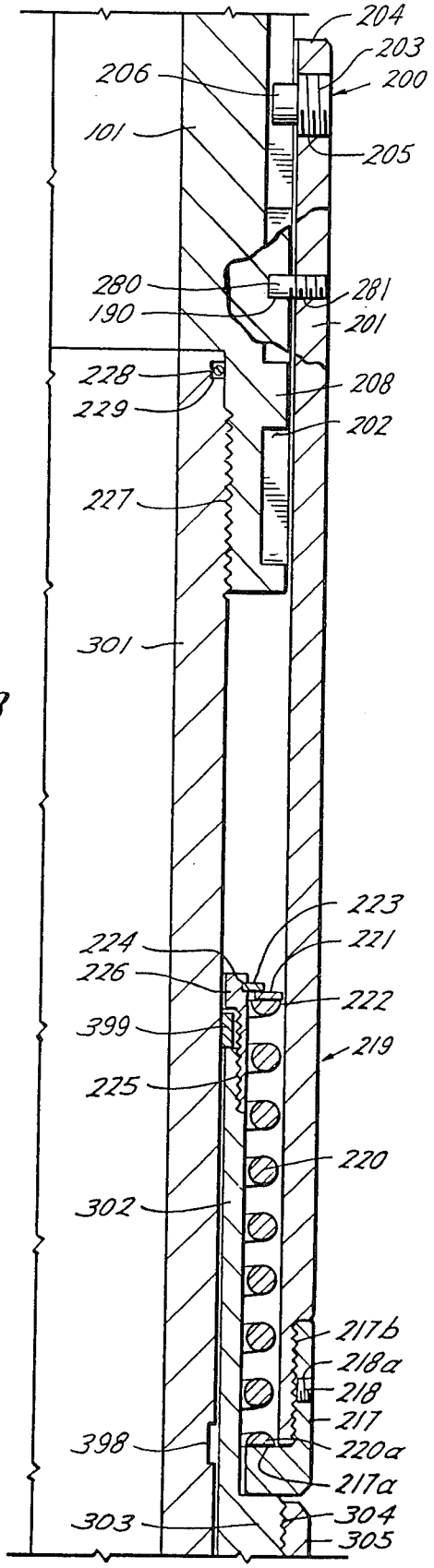

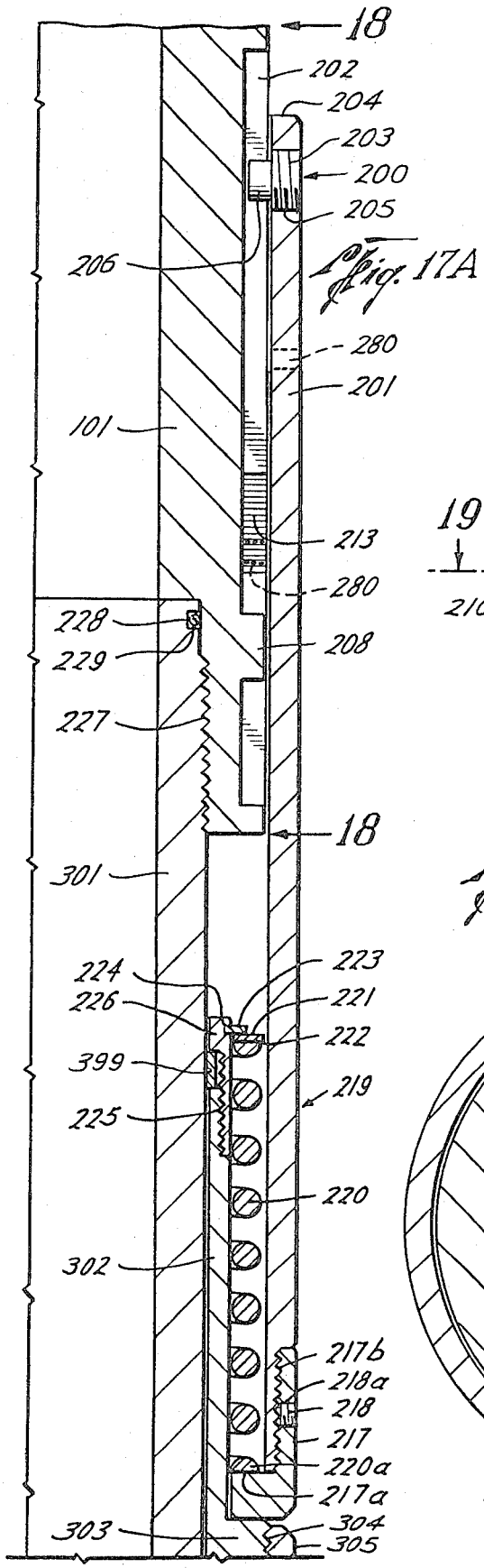
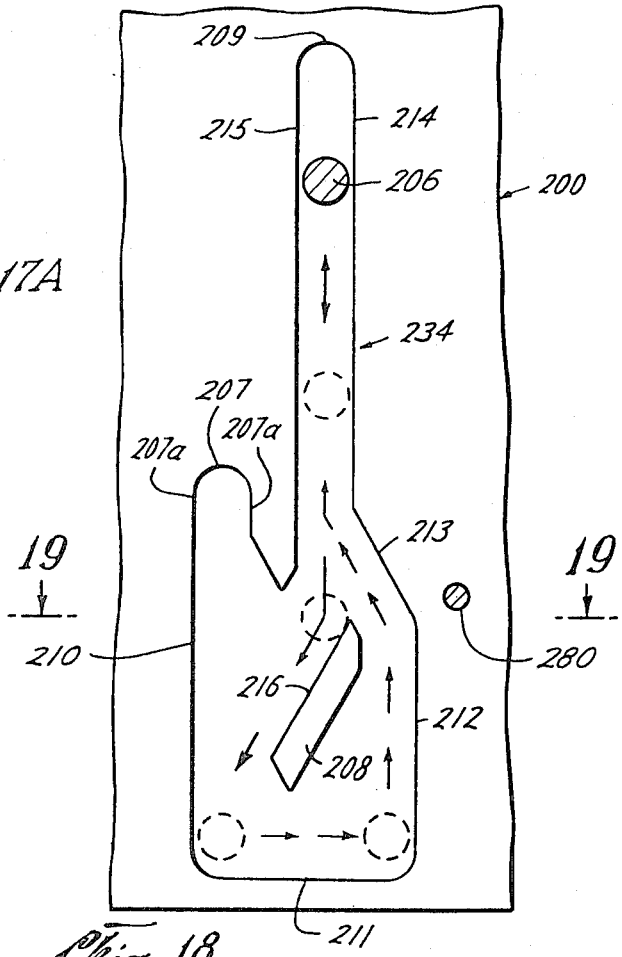
Fig. 18
Fig. 19
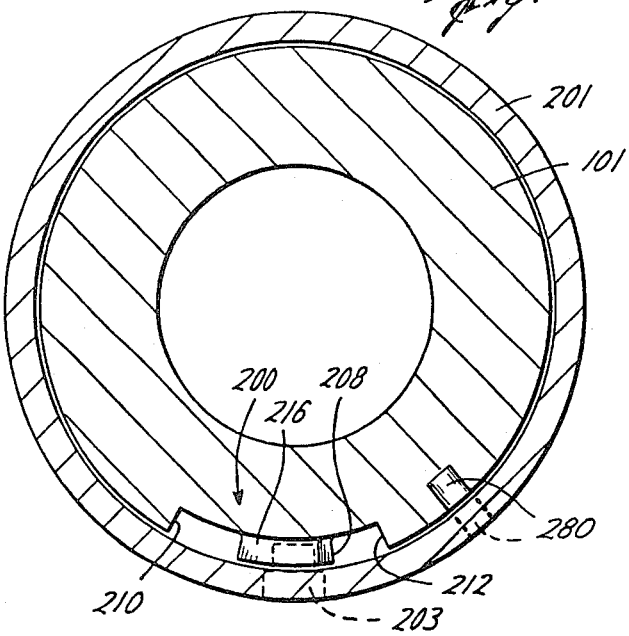

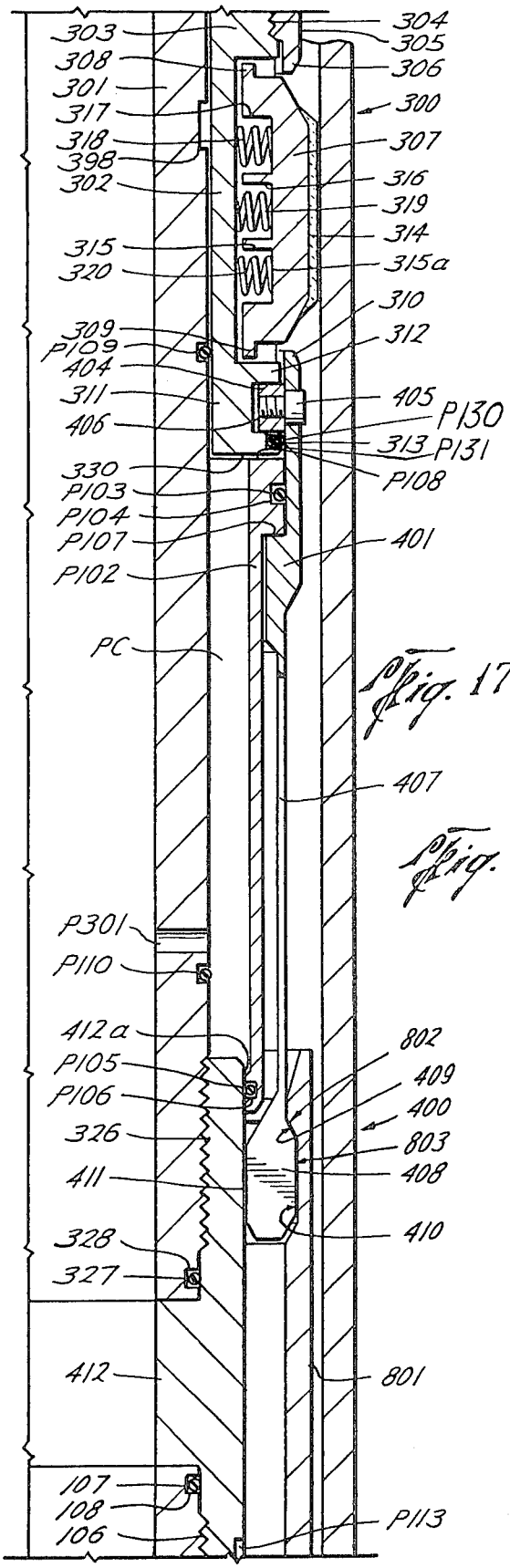
Fig. 17B
Fig. 17C
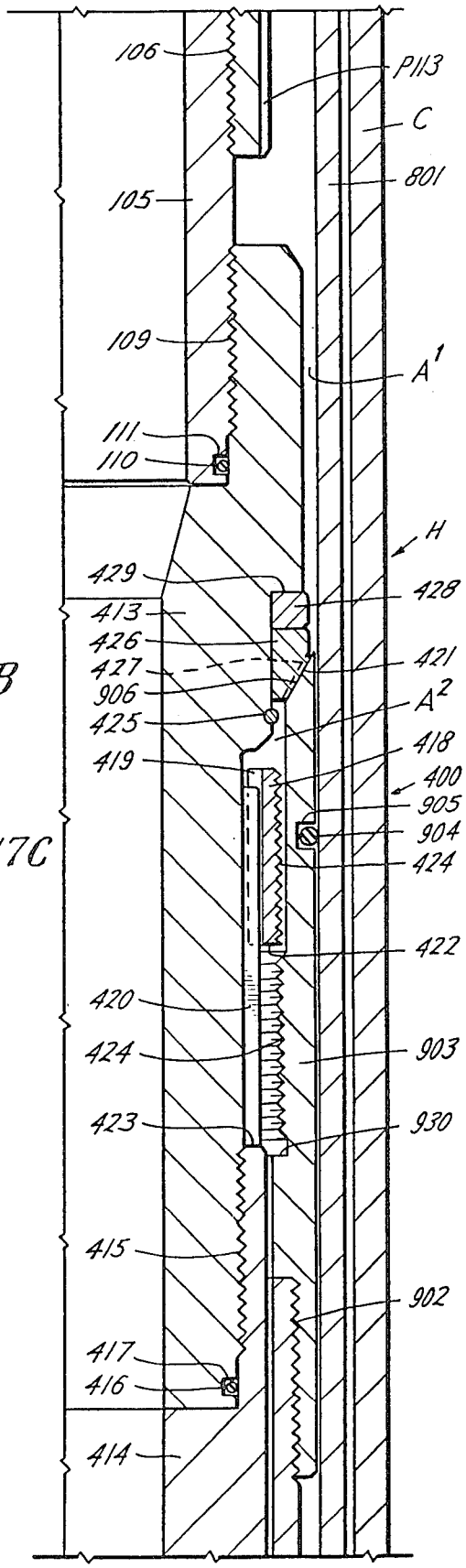

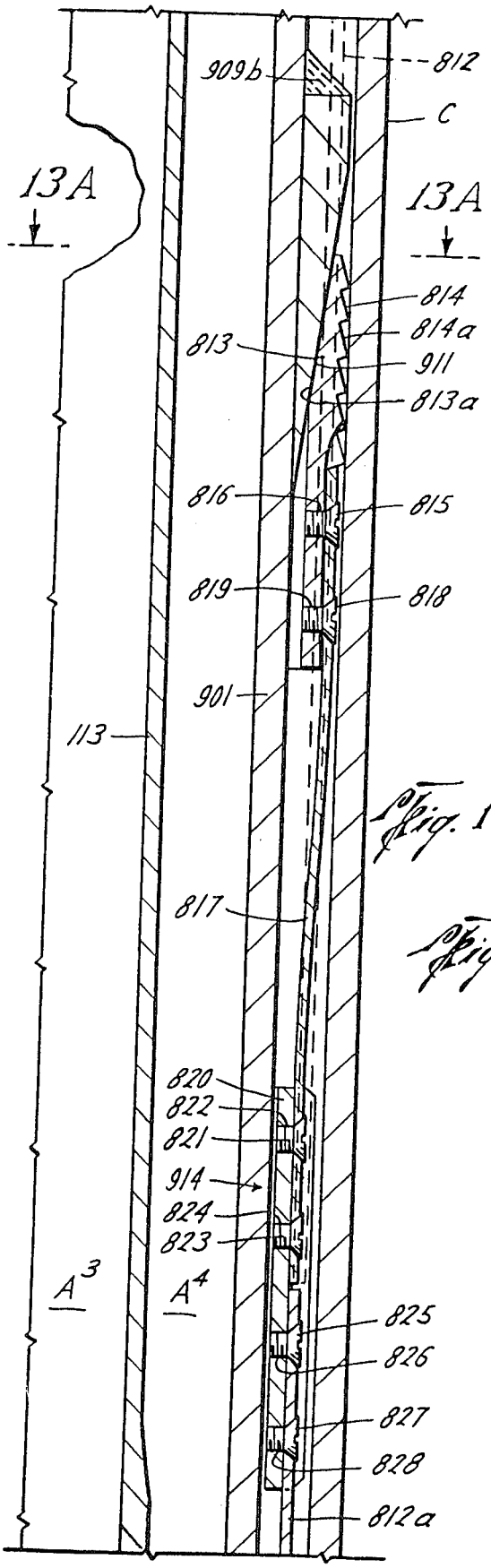
Fig. 17D
Fig. 17E
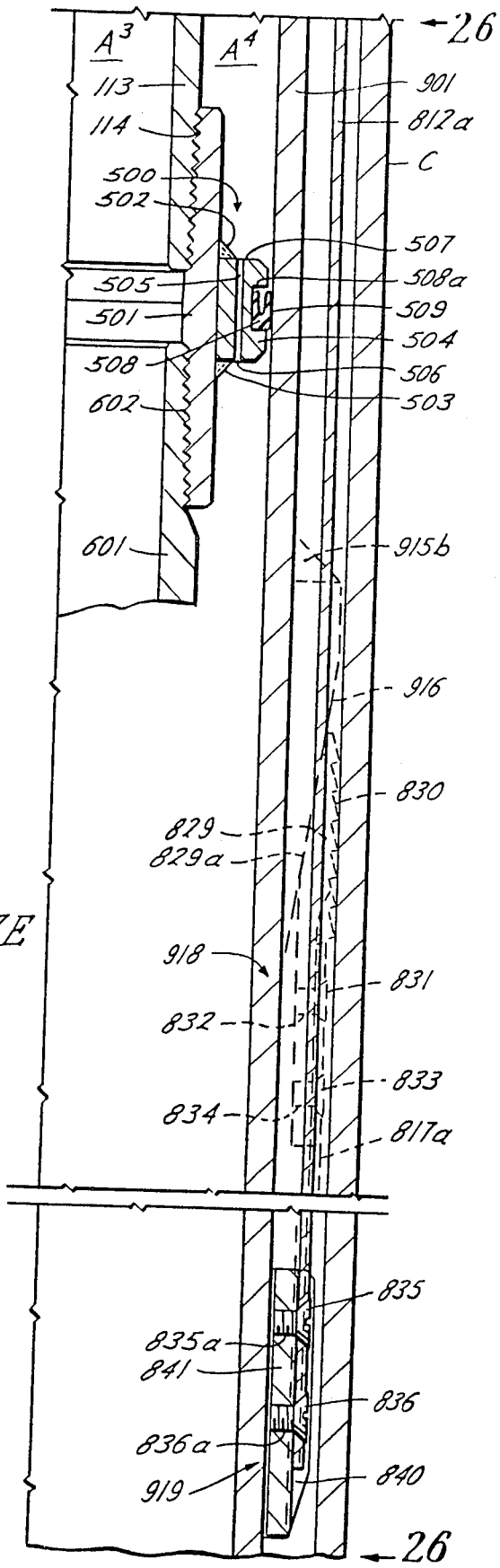

220
P109
217
305
303
C
300
301
307
302
P301
P110
311
405
P130
P131
401
P103
P102
407
412
411
P105
400
409
408
802
105
801

901
620
812a
817a
1005
1004
624
1009
1006
1007
841
1000
1010
1001
1008
1011
601
22
22
1012
626
703
1014
1013
1003
702a
1019
1018
709
1017
1021
719
1020
716
715a
1023
1002
921
920
1022
923
723
922
701

HYDRAULICALLY SET LINER HANGER AND RUNNING TOOL WITH BACKUP MECHANICAL SETTING MEANS

CROSS-REFERENCE TO RELATED APPLICATION

The present application is a continuation-in-part application of co-pending application Ser. No. 758,359, filed Jan. 10, 1977, entitled "Mechanically Set Liner Hanger And Running Tool" now U.S. Pat. No. 4,060,131.

BACKGROUND OF THE INVENTION

1. Summary of the Invention

The present invention relates to a hydraulically set liner hanger assembly for the setting within a subterranean oil or gas well of a length of casing (commonly referred to as "the liner") in the well prior to cementing the liner within the well.

2. Description of the Prior Art

Commercially available mechanically set liner hangers have utilized spring mechanisms and a "J" slot mechanism to set the tool. When setting the liner in an extremely deep well, as well as in operations requiring comsiderable reciprocation of the drill pipe, continued frictional contact of the springs with the internal casing surface will cause the spring mechanism to wear out heavily, which may result in failure of the liner hanger assembly to properly set within the casing at the desired location.

Prior art mechanically set liner hangers provide the setting mechanism as an integrable part of the hanger assembly, the hanger assembly and the setting mechanism being left in the hole after the cementing process. This setting mechanism consists of the springs and a "J" slot mechanism. Since available space between the O.D. of the liner hanger and the I.D. of the casing is usually considerably restricted, the fragile spring assemblies are easily damaged. Additionally, the amount of drag available for activating the "J" slot mechanism is limited and difficulty is sometimes experienced in setting the liner hanger. Accordingly, the present invention overcomes this disadvantage by incorporating a drag mechanism and a "J" slot assembly within the runnin tool itself to provide space to use a drag block mechanism as opposed to a spring mechanism. Additionally, because the setting mechanism is comparatively expensive, it is now retrievable from the well since it is within the running tool, as opposed to being part of the hanger assembly, and can be repeatedly utilized innumerable times.

Many commercially available mechanically set liner hanger assemblies utilize a series of circumferentially extending, longitudinally protruding elongated spring-like mechanisms which produce a drag on the hanger assembly as it is shifted longitudinally within the well bore for inter-relation with and operation of the "J" slot assembly to mechanically activate and set the hanger and to release the running tool from the hanger. The present apparatus utilizes a plurality of drag "block" mechanisms, as opposed to the circumferentially extending longitudinally protruding prior art spring assemblies. While spring assemblies can effectively carry only a minimum number of sets of slips, the utilization of the present drag block assembly permits adaptation for effective use with multiple sets of slips. Additionally, the present invention provides a drag block mechanism which provides one unitized mechanical setting assembly incorporating the drag blocks as well as the "J" mechanism. Moreover, it should be noted that the present drag block mechanism does not swivel with respect to the conical pad elements and slip assembly. However, the conical pad elements and slip assembly are free to swivel with respect to the drag block assembly if the drill pipe is rotated such as when the hanger is mechanically set. The stationary position of the drag block assembly during drill pipe rotation prevents excessive wear on the exterior of the drag block mechanism which, in turn, permits longer life and assures reliability of the drag block mechanism.

Liner hanger assemblies may not provide means for fail safe setting in the event of excess rotation of the drill pipe. The present invention overcomes this disadvantage by providing means which, after a predetermined number of right-hand rotations of the drill pipe, automatically sets the liner hanger within the well, so that the hanger does not fall to the bottom of the hole.

Many prior art liner hanger assemblies provide slip mechanisms which are circumferentially off-set from the cone mechanisms therefor because one of the mandrels carrying the cones or the slips is free to rotate with the drill pipe. Rotation of the mandrel carrying the slips or the cones is required for the slips to become aligned longitudinally with the cones. The present invention overcomes this obstacle by providing a setting mechanism which requires only vertical movement of the conical pads relative to the slips, thus affording utilization of wider conical pads and slip mechanisms and, in turn, affording greater weight carrying capability to the hanger.

In co-pending application Ser. No. 758,359, filed Jan. 10, 1977, there is disclosed a unique mechanically set liner hanger and running tool utilizing drag blocks and a "J" slot mechanism within the running tool for setting of the hanger. There are many instances when it is desirable to set a hanger in a hole which is deviated, i.e., within a sloughing formation or in which mechanical activation is impractical or difficult. The present invention provides a hanger and running tool which incorporates the features set forth above, but which also provides means within the running tool for hydraulically setting of the hanger. By utilizing a piston and associated chamber within the running tool, and not within and on the hanger, a larger effective piston area may be provided, thus reducing the differential pressure across the piston head necessary to activate the setting of the hanger. Additionally, by incorporating such a piston and chamber within the running tool, the complete tool becomes more economical, since the running tool is retrieved from the well and repeatably utilized. More importantly, by incorporating the hydraulic setting means into the present apparatus, there is provided a normally hydraulically settable liner hanger which contains means therein for mechanical setting of the hanger in the event that the tool does not maintain sufficient pressure for hydraulic activation.

In many presently available liner hanger assemblies, the pumping of the cement slurry down the drill pipe and through the interior of the apparatus results in a greater pressure on the outside of the setting tool than that on the inside of the setting tool which results in a differential pressure across the particular component of the apparatus and enables a slurry flow to come between the hanger and the running tool. This can cause cement contamination around some parts of the hanger assembly as well as disengagement of a wiper plug assembly connected by a conventional shear pin to a mandrel, and/or greatly damage the elastomeric wiper cup assembly itself. The present invention overcomes this obstacle by providing a side seal assembly to resist such a slurry flow between the hanger and the running tool, and which is also operational upon picking up of the drill pipe during the sequence in releasing the running tool from the hanger to provide a check means for detecting release of the running tool from the hanger. During the releasing sequence, the weight indicator at the surface of the well might not indicate that the setting tool is released from the liner hanger because there would not be reflected thereon sufficient weight variation. Accordingly, the drill pipe rams are closed and pressure within the drill pipe-casing annulus is increased while the drill pipe carrying the running tool is pulled during retrieval of the running tool from the hanger. A pressure drop within the drill pipe-casing annulus signifies that the side seal has become unseated in its bore within the hanger and is now positioned immediate the upper end of the hanger. Since the side seal is carried on the running tool, the positioning of the side seal out of its normal position within the bore will indicate disconnection of the running tool from the hanger.

Prior art liner hanger assemblies have utilized wiper plug assemblies to wipe cement clean from the casing by utilizing a shear pin mechanism which affixes the wiper plug to the running tool. During many operations, the drill pipe will be picked up or lowered and pressure surges may be trapped to create a pressure differential which will shear the shear pin affixing the wiper plug to the running tool. Accordingly, the wiper plug is enabled to free flow to the bottom of the well and is caught within the float shoe or other mechanism at the bottom of the liner. Since the wiper plug is thereby dropped, it is not available to operationally associate with the cement plug which is pumped down the drill pipe ahead of the circulated drilling fluid. Accordingly, completion of the cementing operation cannot be detected at the well surface. The present invention overcomes this obstacle by providing a wiper plug assembly which is held onto the running tool by a mechanism which is operationally pressure insensitive and which permits pressure equalization therearound so that pressure surges are unsuccessful in releasing the wiper plug from the running tool.

SUMMARY OF THE INVENTION

The present invention provides an apparatus and method for running, setting and anchoring a liner in a well bore casing. The apparatus is connectable to a tubular member which is extendible to the top of the well. The apparatus comprises an inner longitudinally extending body with an outer longitudinally extending body being around the inner body. Connection means on one of said inner and outer bodies are provided for connection of a liner extending below the apparatus. Expander means are carried on one of the inner and outer bodies, with gripping means being carried on the other of the inner and outer bodies. The gripping means are engagable with the expander means such that the gripping means are shifted into gripping engagement with the casing. A manipulatable tubular tool is releasably secured to the inner and outer bodies. Drag means are mounted on the running tool and are slidable longitudinally along the casing, the drag means resisting longitudinal travel of the apparatus while in the well bore with sufficient frictional force to support the weight of one of the inner and outer bodies therebelow during mechanical setting of the apparatus. Disengaging means are provided for selective disengagement of the running tool from the inner and outer bodies. Setting means are carried on the running tool and are operably associated with the drag means during mechanical setting, the setting means being responsive to longitudinally shift one of the inner and outer bodies with respect to the other of the inner and outer bodies to anchor the liner to the casing. A piston element is carried on the running tool and is responsive to fluid pressure entrappable in a piston pressure chamber to hydraulically set the liner. Wiper means selectively disengagable from the running tool are provided together with means for disengagement of the wiper means from the running tool. Side seal means are carried on the running tool to detect disengagement of the running tool from the inner and outer bodies.

BRIEF DESCRIPTION OF THE DRAWINGS

FIGS. 7A through 7J are longitudinal sectional drawings illustrating the position of the respective parts of the running tool and the hanger durng running thereof into the well and prior to activation for setting of the slips onto the casing, with:

FIG. 7A illustrating the upper end of the running tool, the gauge ring and the upper end of the "J" slot;

FIG. 7B being a lower continuation of FIG. 7A and illustrating the running position of the "J" slot pin carriage shearably secured within the "J" slot, and the drag block housing and spring member being shown therebelow;

FIG. 7C being a lower continuational view of FIG. 7B, showing the hydraulic piston and chamber area, drag block assembly and the collet mechanism therebelow;

FIG. 7D being a lower continuational view of FIG. 7C, illustrating the floating nut assembly;

FIG. 7B being a lower continuation of the view shown in FIG. 7D, and particularizing the spline pin and the longitudinal slot of the outer mechanism and inner assembly of the hanger and the ring strap assembly therebelow;

FIG. 7F being a longitudinal continuation of the view as shown in FIG. 7E, illustrating the relationship of the conical pads to the slip elements therebelow;

FIG. 7G being a lower continuational view as shown in FIG. 7F, and illustrating the side seal assembly and swab cup assembly below the side seal assembly, a second or lower set of conical pads and slips being illustrated immediate the swab cup assembly;

FIG. 7H being a lower continuation of FIG. 7G, and illustrating the engagement of the wiper plug assembly to the running tool;

FIG. 7I being a lower continuation of FIG. 7H, and illustrating the lowermost portion of the wiper plug assembly; and FIG. 7J being a lower continuational view shown in FIG. 7I, illustrating the landing collar for initial engagement of the ball seat used in the hydraulic setting of the hanger, and also showing wiper and cement plug assemblies immediately above a float shoe affixed at the lower end of the liner.

FIGS. 17A, 17B, 17C, 17D and 17E are longitudinal sectional views, in respective series, illustrating the running tool and the hanger while the slips are set within the conical pads to anchor the hanger onto the casing, with:

FIG. 17A illustrating the set position of the carriage element of the "J" slot pin in the "J" slot, and the drag block housing and spring therebelow;

FIG. 17B showing the hydraulic piston and chamber area, the drag block assembly and collet mechanism affixed thereto;

FIG. 17C showing the floating nut in disengaged position on its splineway;

FIG. 17D showing the upper set of conical pads and slips in engaged position; and FIG. 17E illustrating the lower set of conical pads and slips in engaged position on the casing, and the side seal assembly of the running tool thereabove.

FIG. 18 is a longitudinal sectional side view taken along lines 18—18 of FIG. 17A illustrating the view through the "J" slot assembly and showing the positions of the carriage during the running and setting positions for the hanger and the position for retrieval of the running tool.

FIG. 19 is a cross-sectional view taken along lines 19—19 of FIG. 18 and illustrating the carriage of the "J" pin during running within the "J" slot assembly.

DESCRIPTION OF THE PREFERRED EMBODIMENTS

Figures 1, 2, 3:
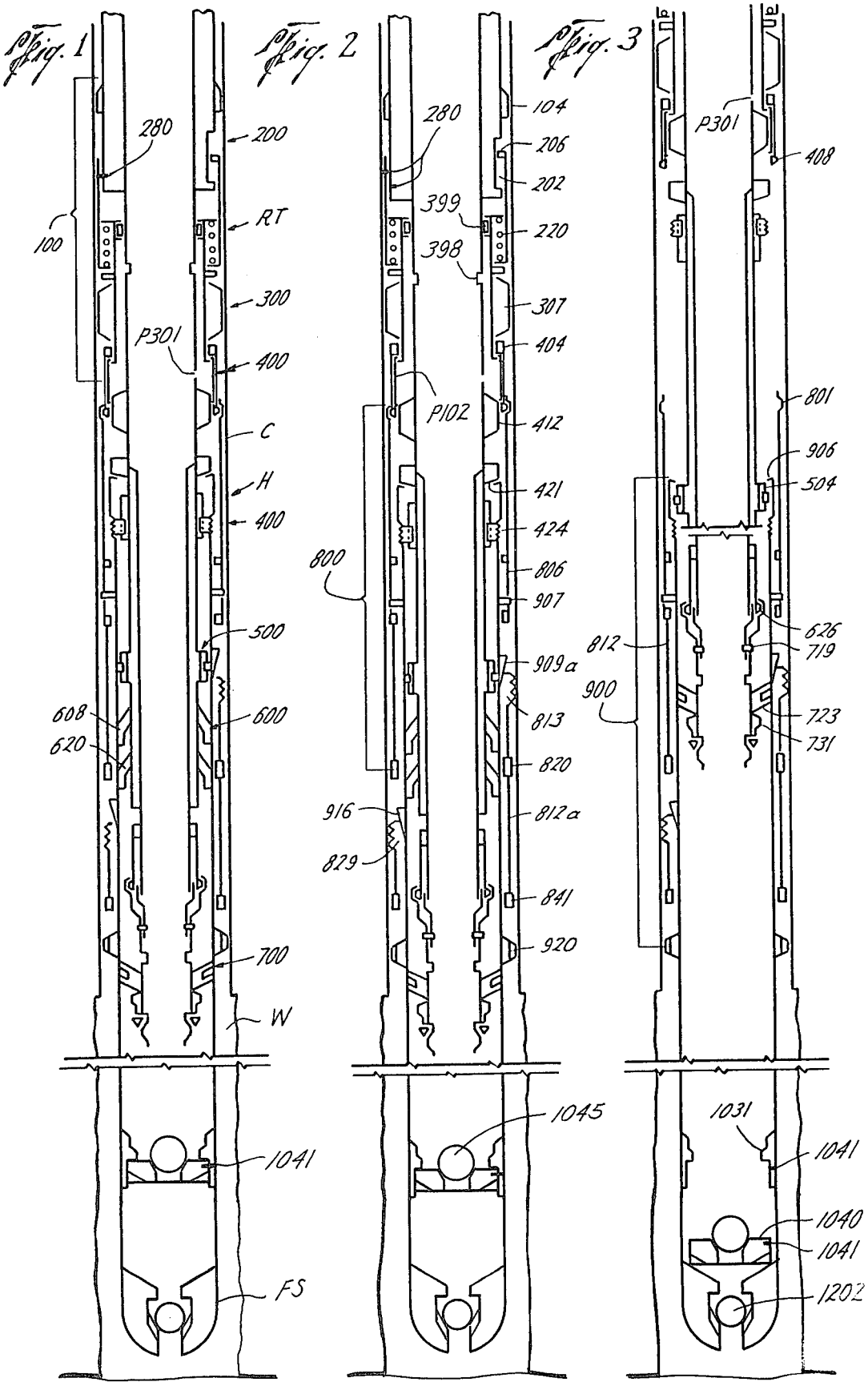
FIG. 1 is a longitudinal schematic view showing the running tool, the hanger and the liner therebelow in position within the bore of the well prior to the setting of the slips on the wall of the casing.
FIG. 2 is a similar schematic view as that shown in FIG. 1 illustrating the running tool and the hanger after the setting of the slips along the wall of the casing.
FIG. 3 is a similar longitudinal schematic view showing the positioning of the side seal immediately above the upper end of the hanger after disengagement of the running tool from the hanger and movement upwardly and away from the hanger for pressure testing the well to detect at the top of the well the setting of the hanger and the disengagement of the running tool.
Figures 4, 5, 6:
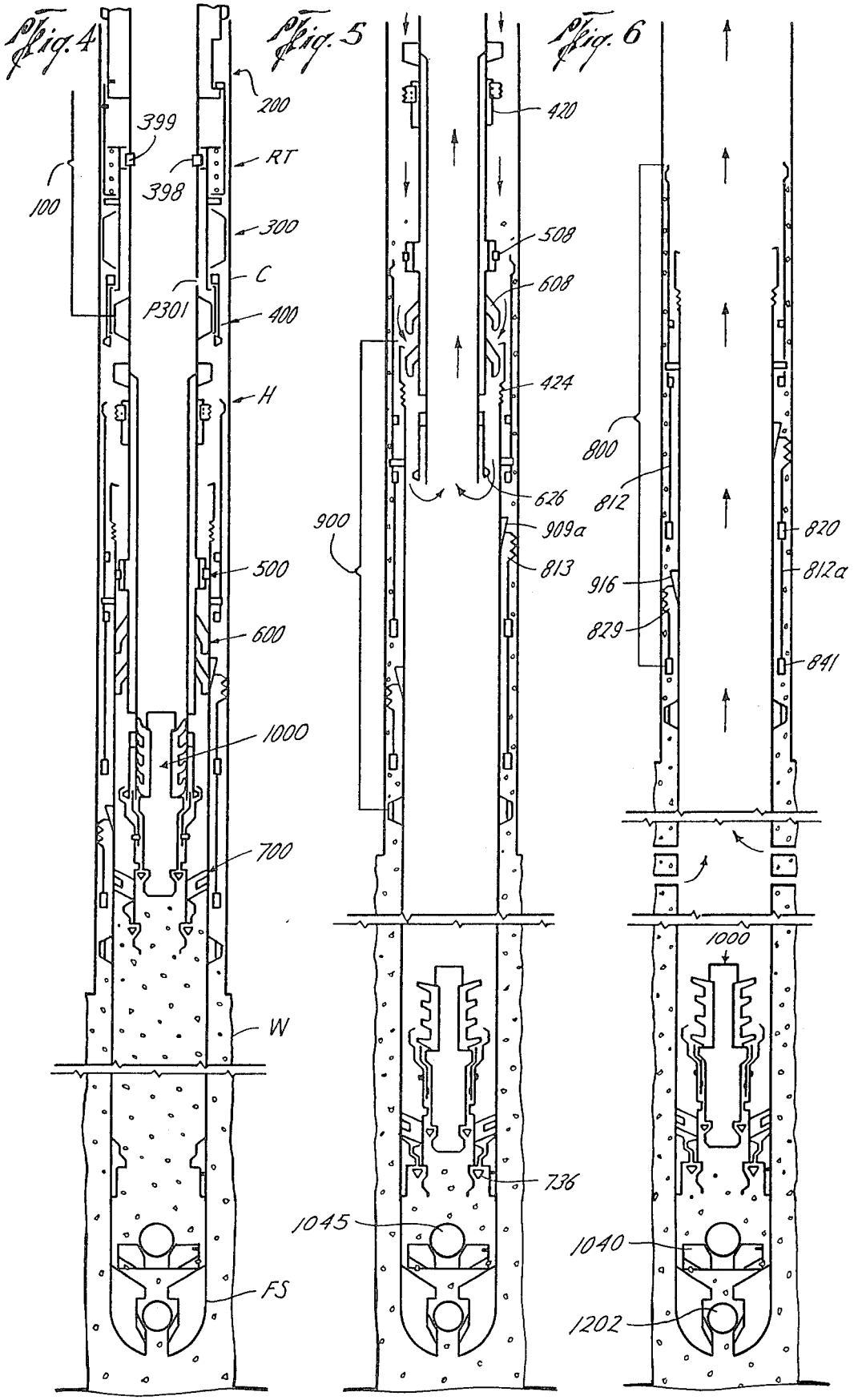
FIG. 4 is a longitudinal schematic view of the apparatus in position during the cementing operation to cement the liner, with the drill pipe cement plug being engaged along the wiper plug assembly.
FIG. 5 is a longitudinal schematic view illustrating the position of the wiper plug-cement plug assembly immediate the float shoe and the positioning of the running tool above the upper end of the liner. Reverse circulation of drilling mud is shown down the casing-drill pipe annulus and through the drill pipe to wash out cement above the hanger.
FIG. 6 is a longitudinally schematic illustration showing retrieval of the running tool from the well with the liner thereafter being perforated and production being transmitted through the cemented hanger to the top of the well.

As shown in the FIGS., the present invention basically is comprised of a running tool RT and a hanger H. The running tool RT, in turn, is generally comprised of a "J" slot mechanism 200, a drag block assembly 300, a releasing mechanism 400, a side seal assembly 500, a swab cup assembly 600, and a plug assembly 700. The hanger H generally comprises an outer mechanism 800 and an inner mechanism 900.

Although not part of the running tool RT or the hanger H, a drill pipe plug assembly 1000 is provided and is utilized during the cementing operation described below.

Figures 7C, 7D:
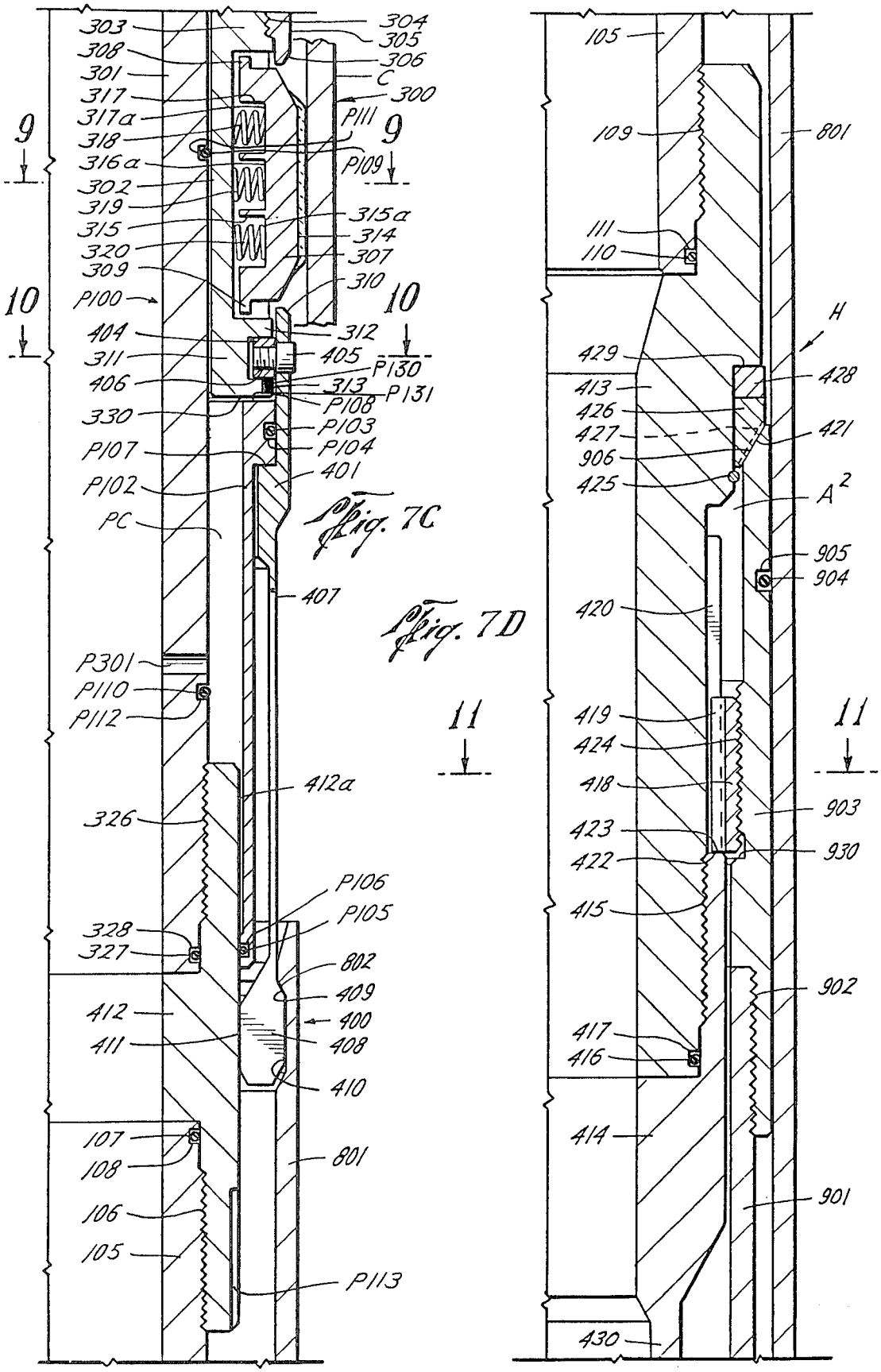
Figure 7E:
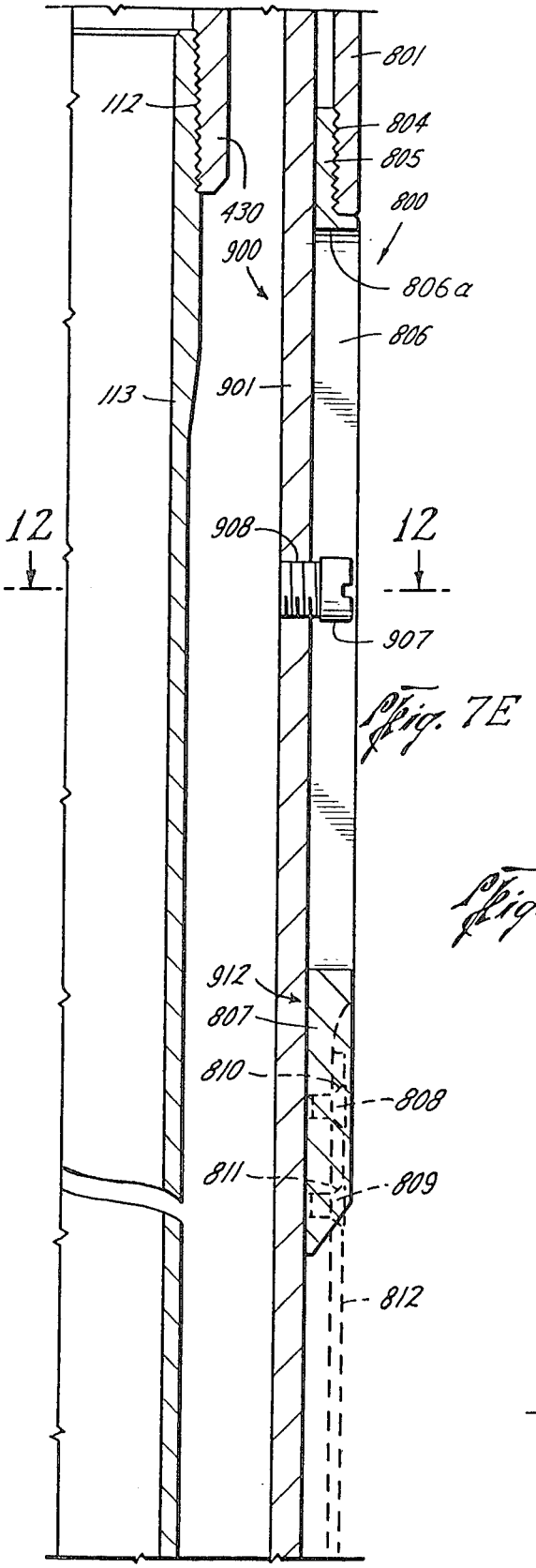
Figure 7F:
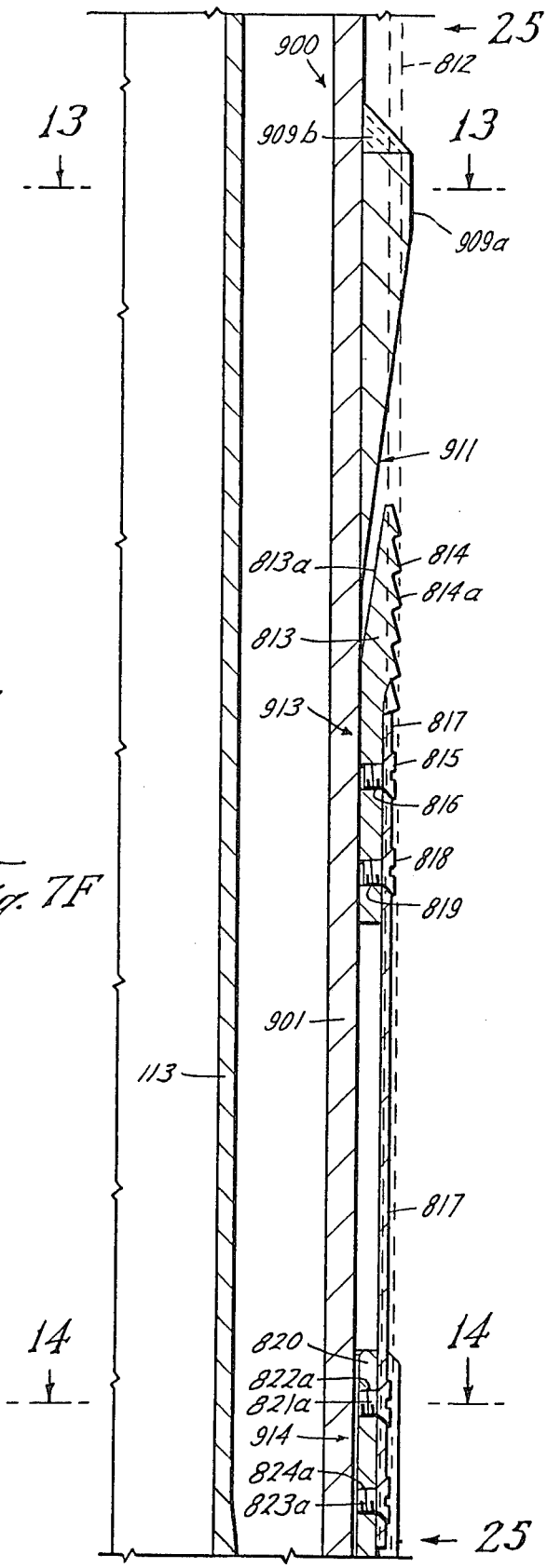
Figure 8:
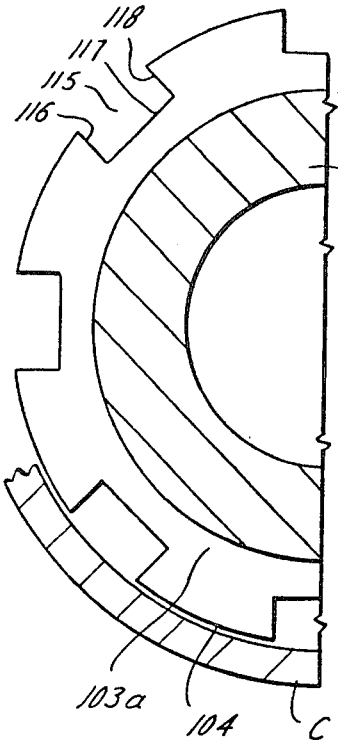
FIG. 8 is a partial sectional view taken along the lines 8—8 of FIG. 7A illustrating the gauge ring and passageways therethrough.
Figure 9:
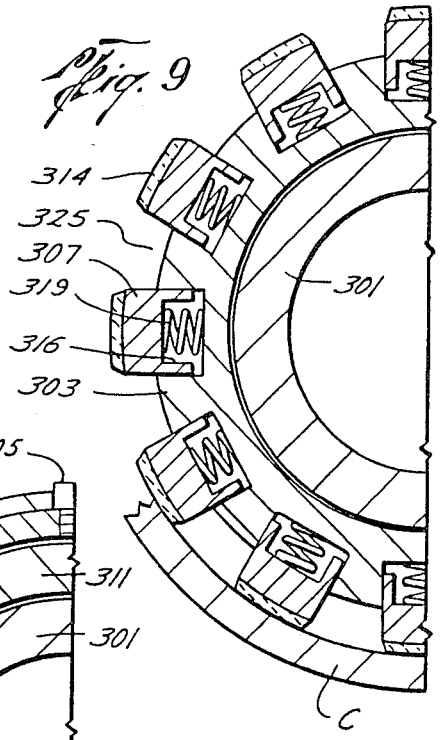
FIG. 9 is a partial sectional view of the drag block assembly taken along lines 9—9 of FIG. 7C.
Figure 10:
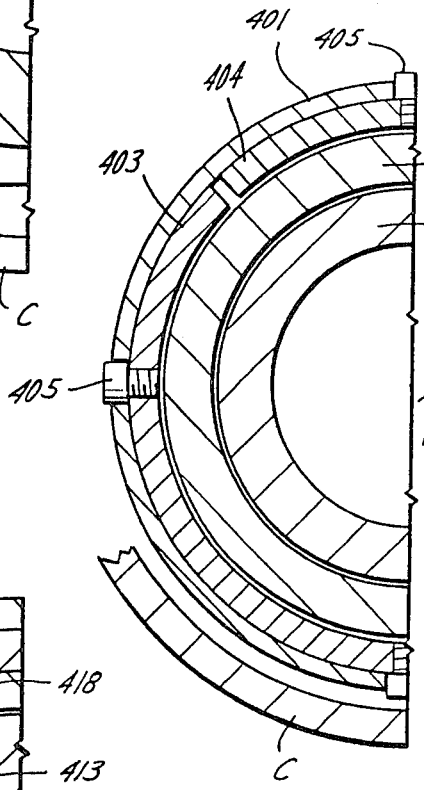
FIG. 10 is a partial sectional view similar to that shown in FIG. 9 and taken along lines 10—10 of FIG. 7C illustrating the collet mechanism housed by its retainer ring to the drag block assembly thereabove.
Figure 11:
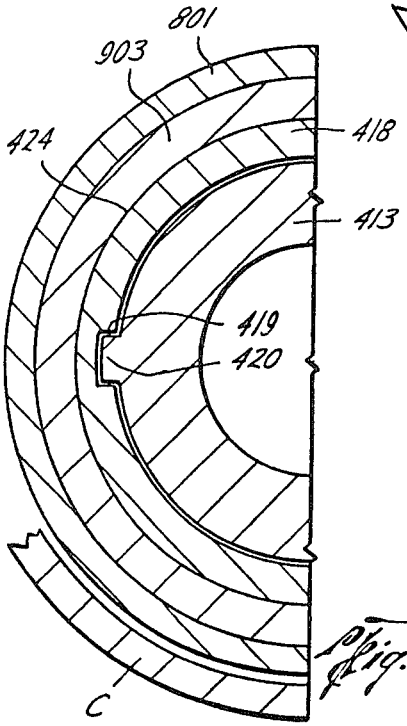
FIG. 11 is a partial sectional view taken along lines 11—11 of FIG. 7D illustrating the floating nut assembly in engaged position.
Figure 12:
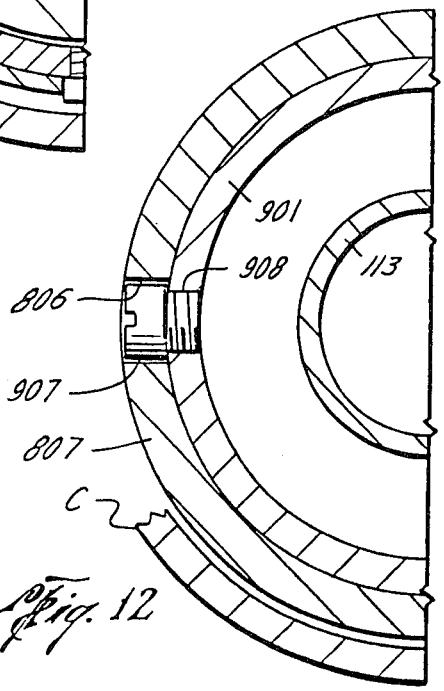
FIG. 12 is a partial sectional view taken along lines 12—12 of FIG. 7E illustrating a spline pin in position within a longitudinal slot.
Figure 13:
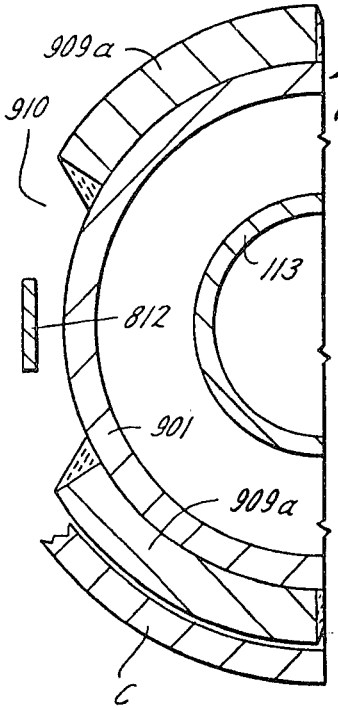
FIG. 13 is a sectional view taken along lines 13—13 of FIG. 7F showing the upper conical pad and ring strap assembly.
Figure 13A:
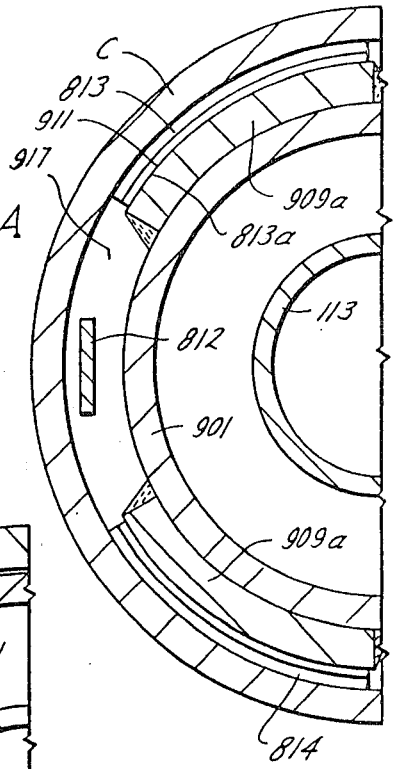
FIG. 13A is a partial sectional view similar to the view shown in FIG. 13, taken along lines 13A—13A of FIG. 17D illustrating the position of the conical pad members within the slip element subsequent to the setting of the hanger onto the casing.
Figure 14:
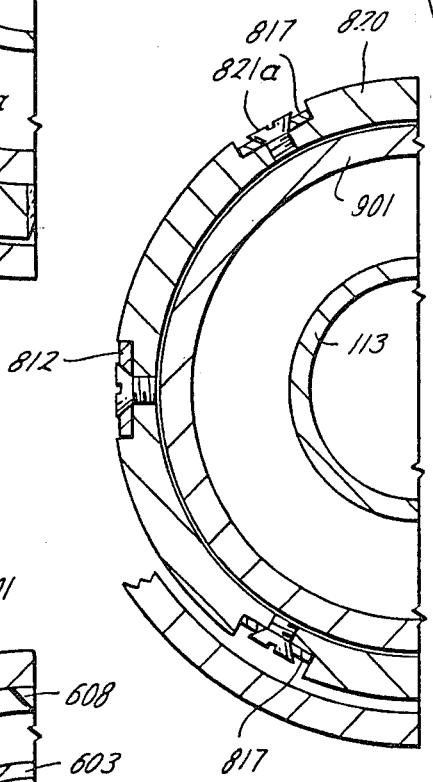
FIG. 14 is a partial sectional view taken along lines 14—14 of FIG. 7F illustrating the slip and ring straps on the retainer element.

Referring now to FIGS. 7A and 8, the running tool RT has an outer housing generally referred to in the drawings as 100. The outer housing 100 has a longitudinal extending top sub member 101 having at the uppermost end thereof inner thread members 102 for securement of a section of drill pipe DP used in conjunction with the running and manipulation of the running tool RT and hanger H, and in the cementing operation, as hereinafter described. A plurality of outwardly protruding gauge ring elements 103 are provided circumferentially around the top sub 101 and are defined on a ring member 103A, to protect the exterior of the running tool RT and the hanger H during manipulation within the well W. The outer surface 104 of the gauge rings 103 acts as a shield and may encounter the inner diameter of the casing C while the running tool RT and hanger H are run within the well. The passageways 115 enable fluid circulation immediate and outside the running tool RT above and below the gauge rings 103.

The running tool RT also contains the "J" slot mechanism 200 (FIGS. 7B, 17A, 18 and 19) which functions in the manipulation of the running tool RT during running and withdrawal in the well as well as in combination with the drag block assembly 300 therebelow, during the mechanical setting of the hanger H. The "J" slot mechanism 200 basically is comprised of an outer cylindrical housing 201 longitudinally extending outwardly from the top sub 101. A plurality of "J" slots 202 form part of the "J" slot mechanism 200, the "J" slot 202 being formed within the lowermost portion of the top sub 101 and below the gauge ring 103. A plurality of inwardly extending "J" pins 203 are inserted within the uppermost end 204 of the outer housing 201 by means of threads 205. The pins 203 each have carriage elements 206 extending inwardly from the outer housing 201 and extending within each "J" slot 202. The carriage elements 206 are initially secured to the top sub 101 by means of shear pins 280 inserted through a bore 281 transversely within the outer housing 201 and secured within a companion groove 190 within the top sub 101. The "J" slot 202 provides a cam way for relative travel of the carriage elements 206 of the pins 203. The "J" slot 202 has a defined "hook" slot thereon for repositioning the carriage element 206 if mechanical setting of the hanger is necessary in the event of failure of the hanger to be set hydraulically, with a minor amount of weight being carried through the top sub 101 and the carriage 206 and, in turn, through the outer housing 201 and its lowermost inter-related parts when the carriage 206 is shouldered within the circular hook 207 of the "J" slot 202. A cam way is provided by the "J" slot 202 for relative travel of the carriage 206 of the pins 203, the cam way being initially defined by an elongated cam way sleeve 234 defined by parallel sides 214 and 215 of the "J" slot 202, the sides circularly terminating at the upper end 209 of the "J" slot 202. The cam way continues downwardly along the longitudinally extending side 210 having the shoulders 207A forming the hook 207 and terminates lowerly and slightly above the lower body portion 211 of the "J" slot 202. Thereafter, the cam way continues latitudinally and immediate the lower body portion 211 until the side 212 is encountered. The cam way then continues longitudinally upwardly within the "J" slot 202 until the carriage element 206 shoulders on the abutment 213, which causes the carriage element 206 to shift slightly latitudinally for entry within the sleeve 234. The cam way also includes an angled abutting slideway 216 extending along an island 208 within the lower body portion of the "J" slot 202, for resisting downward relative travel of the carriage 206 prior to insertion of the carriage 206 within the cam way sleeve 213 and to cause shifting of the carriage 206 for automatic alignment of the carriage 206 with the short cam way for insertion of the carriage 206 in the hook 207 during mechanical manipulation of the drill pipe DP to reposition the hanger H in the well or during mechanical setting of the hanger H.

In the initial running position of the running tool RT and the hanger H within the well W, the "J" slot mechanism with the carriage 206 being secured to the top sub 101 by the shear pin 280 affords a means for transmitting the force caused by downward travel of the drill pipe DP overcoming the resistance of the operation of the drag block assembly 300, through the top sub 101 thence through the upper mandrel 301, as will be hereinafter described. However, upon activation of the tool and relative travel of the carriage element 206 of the pins 203 through the cam way and placement within the sleeve 234, weight can be transmitted through the drill pipe DP, the top sub 101, the upper mandrel 301 and its portions immediately therebelow, as will be hereinafter described.

Also forming a functional part of the "J" slot mechanism 200 is a spring assembly 219 between the upper mandrel 301 of the drag block assembly 300 and the outer housing 201 of the "J" slot mechanism 200. A spring 220 holds the outer housing 201 of the "J" slot mechanism 200 in firm engagement with the housing 302 of the drag block assembly 300 with sufficient friction so that the outer housing 201 of the "J" slot mechanism 200 and the drag block housing 302 rotate together as a unit during manipulation of the drill pipe DP for mechanical setting of the hanger H. The lower end 220A of the spring element 220 rests upon the upper and inwardly protruding surface 217A of a cap member 217 which, in turn, is affixed to the lowermost portion of the outer housing 201 by means by threads 217B. A set screw 218 is inserted within a grooveway 218A to assure proper securement of the cap 217 to the housing 201.

The spring element 220, which circumferentially extends around the drag block housing 302, is operatively engaged thereto at its upper end 222 by means of a drag block-housing cap 226 secured to the drag block housing 302 by means of threads 225. The upper end 222 of the spring assembly 220 is snugly engaged by a circumferentially extending washer element 221 below a ring element 223 inwardly encircling the washer 221 and within a grooveway 224 and circumferentially extending around the drag block cap 226. The spring 220 is operatively engaged at its lower end 220A with the outer housing 201 by means of the cap 217.

Immediately below the "J" slot mechanism 200 and operatively associated therewith is the drag block assembly 300 (FIGS. 7B, 7C, 9, 17B and 20). The function of the drag block assembly 300 is to provide sufficient friction between the assembly 300 and the wall of the casing C to support the weight of the outer mechanism 800, as well as to offer frictional resistance to downward travel of the outer mechanism 800 to afford operation of the "J" mechanism during mechanical setting of the hanger H. Additionally, the drag block assembly 300 offers resistance to rotation of portions of the running tool RT and the hanger H during manipulation of the drill pipe DP.

The drag block assembly 300 is associatably secured to the top sub member 101 by means of threads 227 immediate the lower end 211 of the "J" slot mechanism for securement of the upper mandrel 301 of the drag block assembly 300 to the top sub 101. A circumferentially extending elastomeric O-ring 228 is housed within a grooveway 229 therefor at the uppermost end of the mandrel 301 to prevent fluid transmission between the mandrel 301 and the top sub 101.

Adjacent the upper mandrel 301 and formed between the mandrel 301 and the spring 220 is the drag block housing 302 longitudinally extending below the drag cap 226 affixed thereto by the threads 225. The drag block housing 302 has defined thereon an inwardly urged snap ring 399 which is settable into a companion groove 398 on the upper mandrel 301 during the operation described below. The drag block housing 302 has an outwardly protruding shoulder element 303 above a plurality of drag block members 307 placed circumferentially therebelow and around the housing 302. The housing 302 also carries a complimentary shoulder 311 below said drag block members 307. A drag block retainer ring 305 is affixed to the shoulder 303 by means of threads 304, the drag block retainer ring 305 having a lowerly extending abutment 306 thereon to limit travel of the drag block 307 outwardly away from the housing 302 by engagement with a complimentary abutment 308 at the uppermost end of each drag block 307. A complimentary abutment 309 extends around the lowermost portion of the drag block 307 for operative association with a complimentary upper end 310 on the collet 401, which will be described in detail hereafter. The shoulder 311 of the housing 302 has upper and lower parts 312 and 313, respectively, for housing therebetween of a split retainer ring having ring elements 403 and 404, hereinafter described.

The drag blocks 307 extend circumferentially and exteriorly around the housing 302, but the drag blocks 307 are designed such that fluid passageways 325 are defined between each of said drag blocks 307 to permit transmission of fluid above and below the drag block assembly 300 between the assembly 300 and the casing C. Each drag block 307 has securely affixed as its outermost portion a tough, durable hard core alloy substance, such as tungsten carbide, which provides a shield 314. The shield 314 will slide along the wall of the casing C as the running tool RT and the hanger H are run and manipulated in the hole. The shield 314 is urged outwardly from the housing 302 for contact with the wall of the casing C by means of a plurality of spring elements 318, 319 and 320, extending within their respective bores 317, 316 and 315. The outermost portion of each of the spring elements 318, 319 and 320 engages the outer wall 317A, 316A and 315A, respectively, defining the bores 317, 316 and 315.

The force afforded by the collapsed spring elements 318 through 320 urges the drag block 307 outwardly and away from the housing 302 to cause the shield element 314 to become snugly engaged along the wall of the casing C such that as the running tool RT and the hanger H connected thereto are run within the well W and within the casing C, the drag block assembly 300 will resist longitudinal movement of the running tool RT within the casing C. Although longitudinal movement of the running tool RT and the hanger H within the casing C is resisted by the positioning of the shield 314 along the wall of the casing C, it must be noted and emphasized that the interface of the shield 314 and casing C does not prevent effective manipulation of the running tool RT and the hanger H for insertion and running within the well W, the running tool RT and the hanger H being relatively easily slidable within the casing C at any desired depth within the well W by longitudinal movement of the drill pipe DP.

Immediately below the drag block assembly 300 is the releasing mechanism 400 (FIGS. 7C, 7D, 11, 17B, 17C and 20) which is operative to release the running tool RT from the hanger H after setting of the hanger H in the well W at the desired depth. The releasing mechanism 400 basically is comprised of a collet mechanism 401 which is held in longitudinal alignment between the outer housing 800 of the hanger H and the upper mandrel 301 by means of a connecting sub 412 which connects the upper mandrel 301 of the drag block assembly 300 thereabove to the lower mandrel 105 therebelow, and provides an interface 411 along the outer surface 412A between the collet 401 and the connecting sub 412. The connecting sub 412 is engaged to the upper mandrel 301 by means of threads 326, therebeing an elastomeric O-ring 327 circumferentially extending within a bore 328 defined on the mandrel 301 to prevent fluid communication between the mandrel 301 and the connecting sub 412. A complimentary elastomeric O-ring 107 is circumferentially extended within its grooveway 108 within the mandrel 105 therebelow to prevent fluid communication between the mandrel 105 and the connecting sub 412, the connecting sub 412 being affixed to the mandrel 105 by means of threads 106.

The collet 401 is affixed within the lower shoulder 311 of the drag block housing 302 by means of a split retainer ring having split portions 403 and 404 which, in combination with pin elements 907 within longitudinal slots 806, described below, permits the collet 401 to swivel freely with respect to the drag block housing 302 such that, upon rotation of the drill pipe DP and the running tool RT, the drag block assembly 300 is permitted to remain stationary, but the collet 401 and the outer housing 800 and inner mechanism 900 of the hanger H therebelow are permitted to rotate respectively, thus enabling the conical pads 909 and 915 always to be on longitudinal alignment with respect to their companion slips 813 and 829. The collet 401 is affixed within the split retainer ring portions 403 and 404 by means of cap screws 405 threadedly secured therein through a bore 406 defined in each of the members 403 and 404. The collet element 401 has a plurality of downwardly longitudinally extending finger elements 407 which are collapsible inwardly upon removal of resistance to inner travel thereof, this resistance being afforded by means of the outer surface 412A of the mandrel connecting sub 412. At the lowermost end of each of the finger elements 407 of the collet 401 is a rectangular-like spoon element 408 having an inwardly facing surface which defines the interface 411 with the mandrel connecting sub 412. An outwardly protruding upwardly facing shoulder 409 serves to engage a complimentary and inwardly extending shoulder 802 on the tie back sleeve 801 of the hanger outer housing 800, as described below. A longitudinally extending, outwardly protruding surface 410 on the spoon 408 provides an interface with a companion surface 803 on the mandrel connecting sub 801. Thus, by means of utilization of the spoon 408 in initial position as described, the collet 401 securely engages the outer housing 800 of the hanger H to the running tool RT.

The releasing mechanism 400 not only includes the collet mechanism 401 as described above, but also incorporates and includes a floating nut mechanism basically comprised of a body element 413 secured to the mandrel 105 by means of threads 109, the mandrel 105 providing at its lowermost end and below the threads 109 an elastomeric circumferentially extending seal element 110 housed within a grooveway 111 defined within the mandrel 105 to prevent fluid communication between the mandrel 105 and the body 413. At the lowermost end of th body 413 is a circumferentially extending stinger 414 connected to the body 413 by means of threads 415, therebeing a circumferentially extending elastomeric ring 416 housed within its grooveway 417 in the body 413 to prevent fluid communication between the body 413 and the stinger 414. The stinger 414 has projecting thereon at its lowermost end a longitudinally extending box element 430 which is connected by means of threads 112 to a stinger body 113 immediately therebelow.

A floating nut element 418 extends outwardly away from the body 413 and immediately above the stinger 414, and is connected to the setting sleeve 903 of the inner mechanism 900 of the hanger H by means of left-hand thread elements 424. The floating nut 418, when in engaged position with the setting sleeve 903, has its lowermost end 422 snugly engaged with the uppermost end 423 of the stinger 414. The floating nut 418, after right-hand rotation of the drill pipe DP, as will be described hereinafter, becomes disengaged from the sleeve 903 as it slides longitudinally upwardly along splineways 420 projecting within central cylindrical bores 419 of the floating nut 418. The floating nut 418 will, while the drill pipe DP is rotated to the right, slide upwardly along the splineways 420 until such time as the floating nut 418 is completely released from the setting sleeve 903.

A ring element 426 having a lower end above an outwardly protrudihg snap ring 425 circumferentially extending on the floating nut body element 413 is beveled inwardly along its edge 421. Grooveways 427 are provided within and around the ring element 426 to prevent a metal-to-metal seal between the ring 426 and the upper end 906 of the setting sleeve 903, which, otherwise, could possibly cause a pressure differential above and/or below the end 906 and the ring 426 in the annular areas $A^1$ and $A^2$ adjacent thereto. The beveled ring element 426 is securely and operationally engaged at its upper end with the body 413 by means of a bearing ring 428 which is housed within the body 413 below the lowermost shoulder 429 of the body 413. The bearing ring 428 and the beveled ring 426 transmit drill pipe torque exerted on the running tool RT through the drill pipe DP to the hanger H by means of the setting 903 therebelow during the setting operation described hereinafter.

The releasing mechanism 400 also houses the hydraulic setting piston assembly P100, which interiorly comprises the upper mandrel 301 and the connecting sub 412, and exteriorly comprises the drag block housing 302 and the collet 401. A piston element P102 is housed between the collet 401 and the mandrel 301 and defines therebetween a piston chamber PC for receipt of hydraulic fluid and pressure through a port P301 in the mandrel 301 from within the interior of the running tool RT. An O-ring P103 within its grooveway P104 on the upper end of the piston P102 prevents fluid communication between the piston element P102 and the collet 401. A similar O-ring P105 within its grooveway P106 at the lowermost end of the piston P102 preventsfluid communication between the piston P102 and the connecting sub 412. The piston P102 is carried on the collet 401 at the interface P017.

A plurality of O-rings P109 and P110 are housed on the mandrel 301 and within their respective grooveways P111 and P112 to prevent fluid transmission between the mandrel 301 and the drag block housing 302 when the mandrel 301 is shifted upwardly to release the running tool RT and the hanger H as described below.

A pressure exhaust passageway P113 is defined at the lowermost end of the connecting sub 412 to permit pressure and fluid to be vented from within the chamber PC after the hydraulic setting of the hanger H.

Figures 7G, 7H:
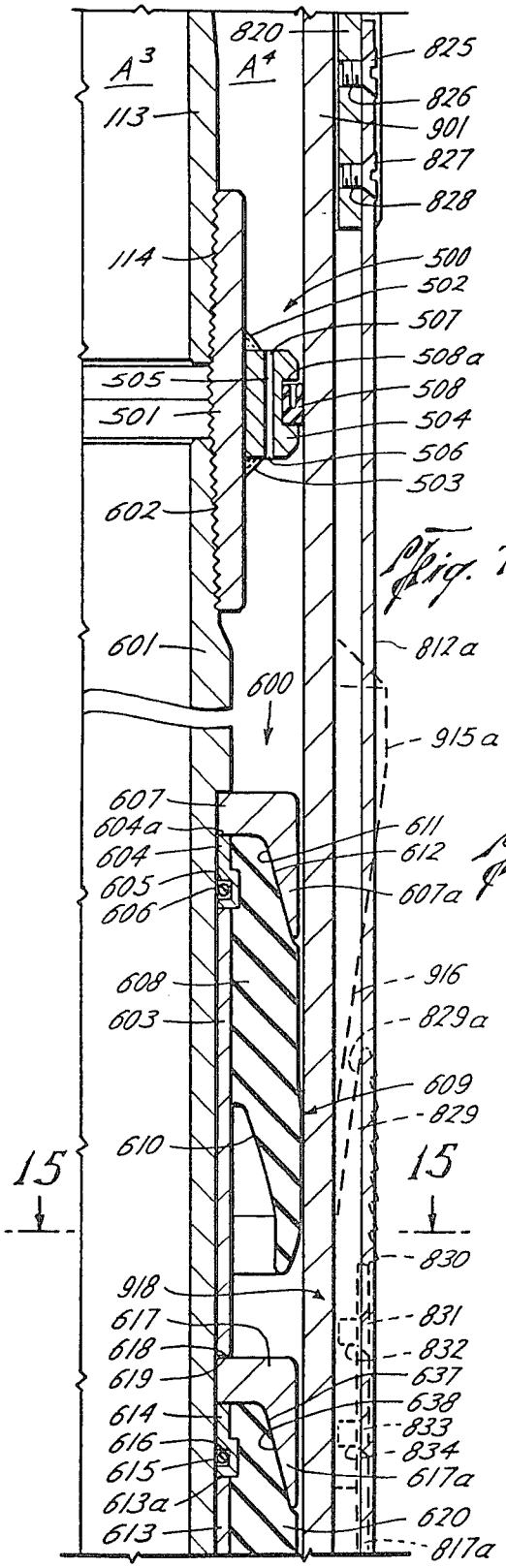
Figure 7I:
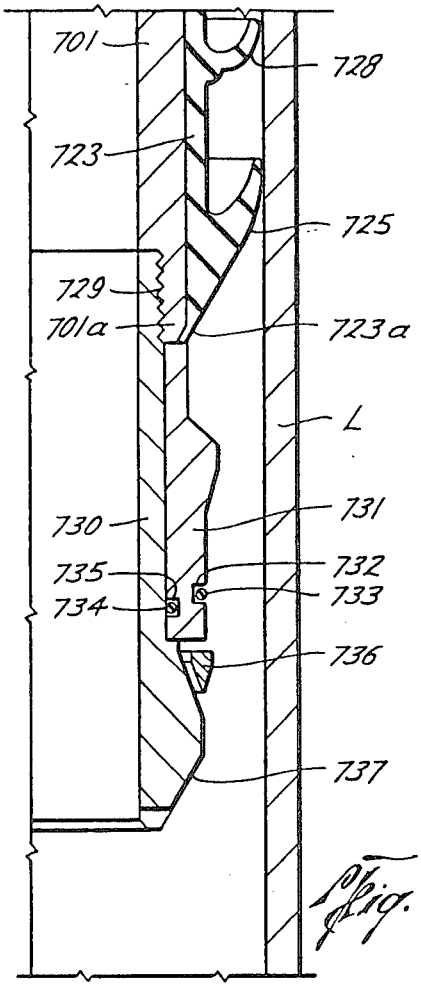

Immediately adjacent to the lower end of the stinger body 113 is an exteriorly affixed side seal assembly 500 (FIGS. 3, 7G and 17E). In deep and deviated wells, there is often a great deal of "drag" upon the drill pipe DP as it encounters the wall of the casing C, and it is sometimes difficult to tell at the top of the well by change in the weight on the weight indicator for the drill pipe DP whether or not the running tool RT actually has been released from the hanger assembly H. To overcome this problem, the side seal assembly 500 is provided and is connected to the stinger body 113 by means of threads 114 to a coupling 501. The coupling 501 is, in turn, affixed at its lowermost end to a longitudinally extending swab cup mandrel 601 by means of threads 602. An elastomeric side seal element 508 is housed within a circumferentially extending grooveway 508A defined within a seal housing 504 which is, in turn, securely affixed to the cupling 501 by means of welds 502 and 503. The seal element 508 is permitted to securely seal against, and also slide along, the outer smooth wall of the inner body 901 of the inner mechanism 900 of the hanger H by means of the outer smooth lip 509 on the seal 508. A plurality of relatively small diameter, longitudinally extending passageways 505 are provided within the seal housing 504, each passageway 505 having upper and lower open ends 507 and 506, respectively, to relieve pressure above and below the side seal assembly 500 and to prevent a pressure differential from existing across the side seal assembly 500.

If pressure is applied within the drill pipe-casing annulus and the annular area $A^3$ of the running tool RT immediately before the running tool RT is withdrawn from the hanger assembly H, the pressure will drop when the seal element 508 travels upwardly out of engagement in the annulus $A^4$ above and past the shoulder 930 on the sleeve 903 because the annulus $A^1$ above the shoulder 930 has a larger diameter across it than the diameter across the annulus $A^4$. Thus, a pressure variance or drop will occur as the element 508 passes from within annulus $A^4$ to within annulus $A^1$ and will produce a force that may alter the apparent weight of the drill pipe DP. Thus, as the side seal assembly 500 clears the bore in which it is in sealing engagement, the pressure will be equalized around the end of the running tool RT and into the drill pipe DP. A pressure drop accompanied by a variation in weight on the drill pipe DP should be noted at the surface of the well W indicating that the liner hanger H is properly hung in position and that the running tool RT is released from the hanger H.

Figure 15:
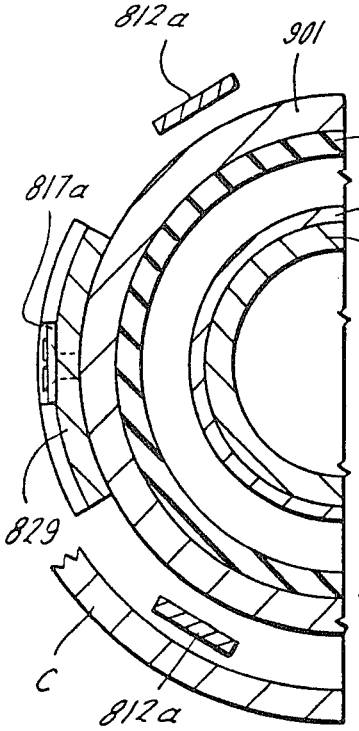
FIG. 15 is a partial sectional view taken along lines 15—15 of FIG. 7G illustrating the swab cup assembly and the lower set of conical pads and slips prior to the setting of the slips onto the casing.
Figure 16:
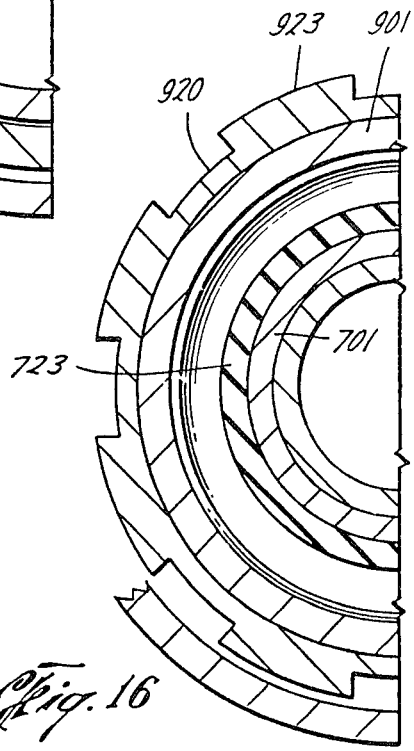
FIG. 16 is a partial sectional view taken along lines 16—16 of FIG. 7H illustrating a view along the wiper cup assembly and the lower gauge ring.
Figure 20:
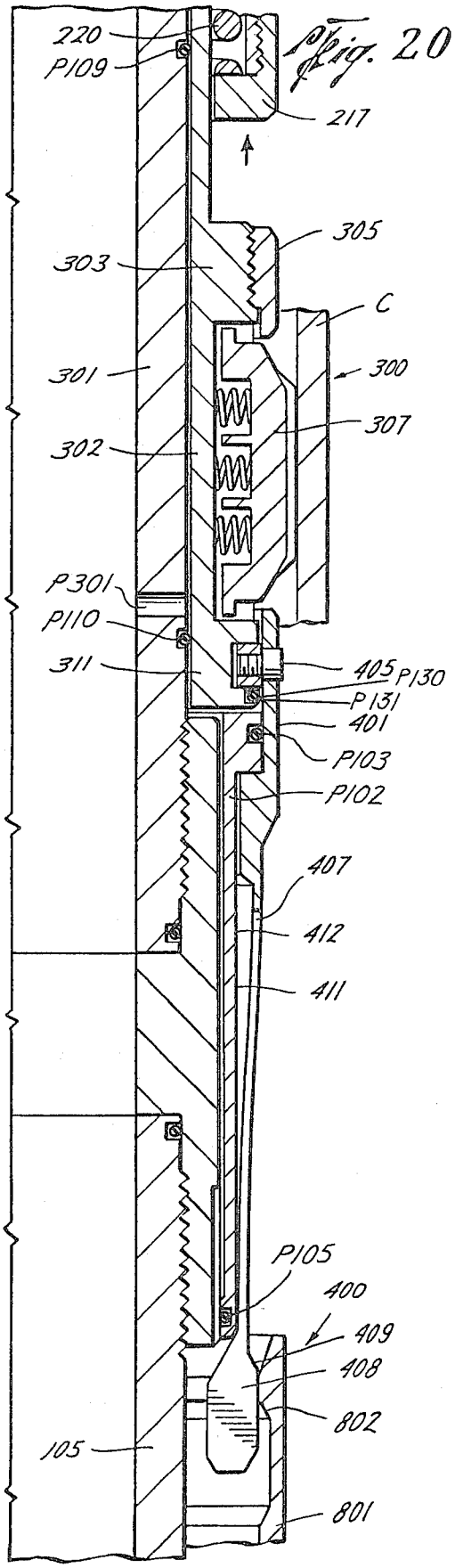
FIG. 20 is a longitudinal sectional drawing illustrating the position of the collet mechanism when it is disengaged from the tie back sleeve therebelow, and the pressure within the hydraulic piston being vented.
Figure 21:
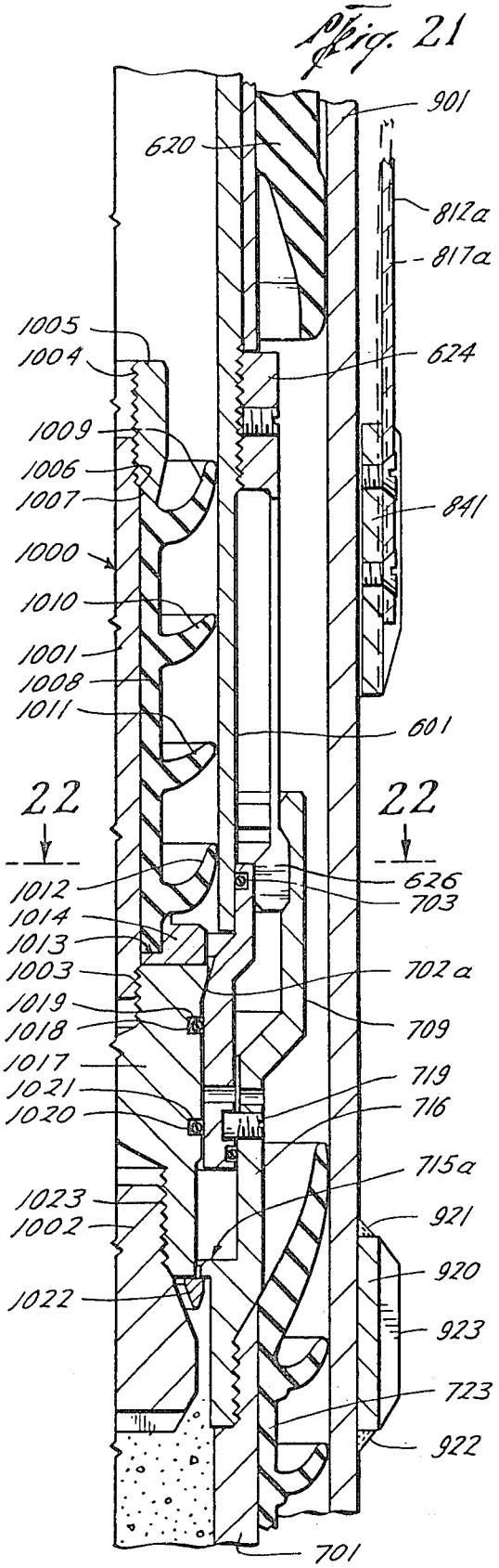
FIG. 21 is a longitudinal sectional view illustrating the engagement of the cementing plug assembly with the wiper plug assembly carried by the running tool.
Figure 22:
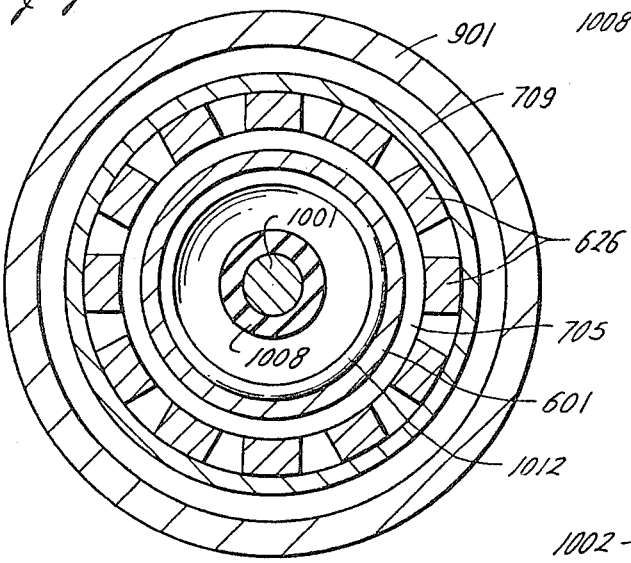
FIG. 22 is a cross-sectional view taken along the lines 22—22 of FIG. 21 and through the cement plug assembly and the collet mechanism affixing the wiper plug assembly to the lower end of the running tool.
Figure 23:
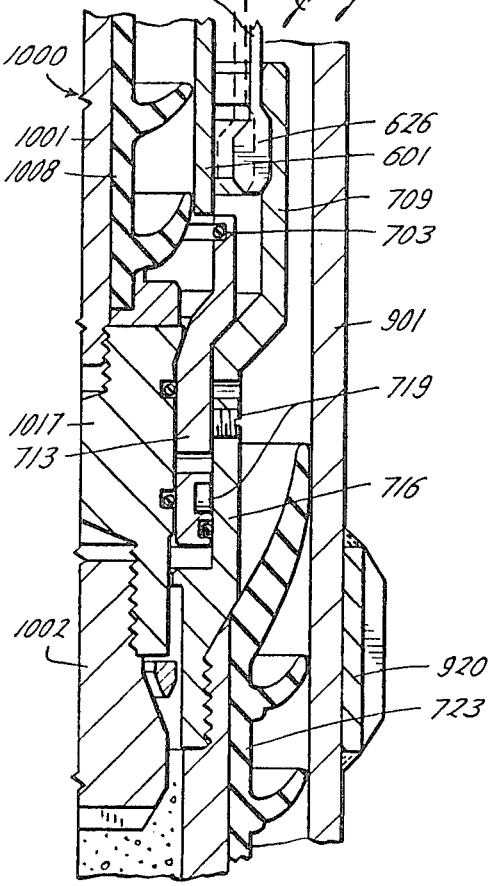
FIG. 23 is a longitudinal sectional view similar to that shown in FIG. 21, illustrating the disengagement of the wiper plug assembly from the lower end of the running tool.
Figure 24:
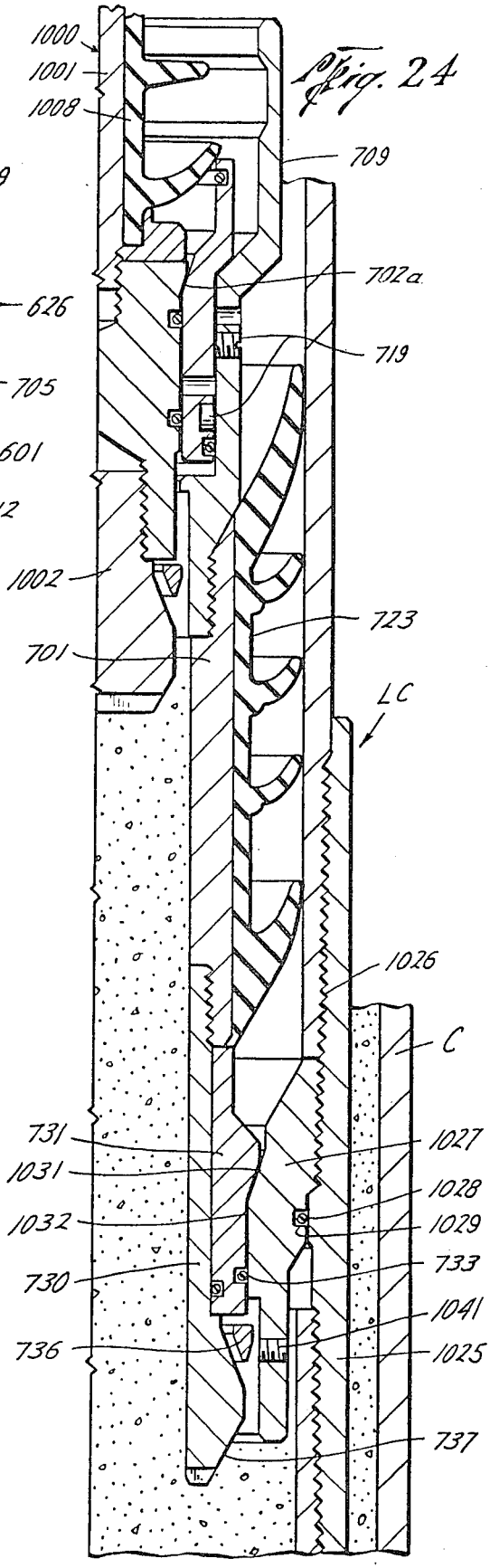
FIG. 24 is a longitudinal sectional view showing the position of the cement plug assembly and the wiper plug assembly carried thereby and inserted within the landing collar immediate the float shoe at the lower end of the liner.

Immediately below the side seal assembly 500 is a swab cup assembly 600 (FIGS. 7G, 7H and 15) connected thereto by means of a longitudinally extending swab cup mandrel 601 being secured at threads 602 to the coupling 501. The swab cup assembly 600 may initially be located within the hanger H or may be affixed on the mandrel 601 at a depth in the well W considerably below the hanger H. The swab cup assembly 600 provides a seal between the running tool RT and the interior fof the hanger H or liner L therebelow to direct cement down the interior of the liner L and to prevent circulation of cement and mud around the immediate lower end of the mandrel 601 and upwardly into the annulus $A^4$.

Formed exteriorly and circumferentially around the swab cup mandrel 601 is an upper sleeve 603 engaging at its uppermost end a ring seal element 604. The ring seal element 604 defines a grooveway 605 therein housing a circumferentially extending elastomeric ring seal 606 to prevent fluid communication between the ring seal 604 and the swab cup mandrel 601. Immediately above the ring seal 604 and contacting the uppermost end 604A therof is a thimble 607 having an exterior and lowerly extending skirt 607A for housing and support of an elastomeric swab cup element 608, the swab cup element 608 having an upper and outwardly extending beveled edge 611 engaged by a complimentary lower extending inwardly beveled edge 612 on the skirt 607A. The swab cup 608 is profiled with an inward hollow portion defined by edge 610 thereon. The swab cup 608 also has an outer longitudinally extending surface or edge 609 which has an outer diameter greater than the inner diameter of the inner mechanism 900 of the hanger H, such that longitudinal shifting of the running tool RT within the inner element 900 will cause the swab cup 608 to slide along and wipe the inner diameter of the inner member 900.

The lower end 618 of the upper sleeve 603 contacts the upper end 619 of a secnd or lower thimble element 617 of design and construction substantially as that of the upper thimble element 607. The thimble element 617 has an inwardly extending beveled surface 637 interiorly of a lower extending skirt portion 617A on the thimble 617 for companion engagement of an outwardly extending beveled surface 638 of a second or lower swab cup 620, the surface 638 having an outer edge or protrusion 621 identical in configuration as the elongated outer edge 609 of the upper swab cup 608.

The lower swab cup 620 is profiled by means of the bored inner area defined by the edge 622 thereon. The swab cup 620 is engaged to a lower sleeve element 613 circumferentially extending around the swab cup mandrel 601. The upper end 613A of the lower sleeve 613 contacts and engages a complimentary ring seal 614, the ring seal 614 having a circumferentially extending elastomeric seal member 615 extending within a grooveway 616 defined within the ring seal 614 and extending around the exterior of the swab cup mandrel 601 to prevent fluid communication between the ring seal 614 and the swab cup mandrel 601.

The swab cup assembly 600 has below the lower swab cup 620 a collect apparatus 624 for connection of the running tool RT to a plug assembly 700 therebelow. The collect 624 is secured to the swab cup mandrel 601 by means of threads 623. A set screw element 631 is affixed through the collet 624 to the swab cup mandrel 601 through a bore element 632 within the collet 624.

The collet 624 has a series of longitudinally extending finger-like elements 625 extending circumferentially around the exterior of the lower portion of the swab cup mandrel 601, each finger element 625 having at its lowermost end a rectangularly shaped spoon element 626 engaging on the exterior thereof a collet releasing sub 709 of the plug assembly 700. Adjacent the inerior of each spoon 626 is a shear sleeve member 705 of the plug assembly 700. Each spoon 626 of the finger-like elements 625 has an outwardly extending upper shoulder 627 which contacts a companion shoulder element 710 extending inwardly on the collet releasing sub 709. A longitudinally extending outer surface 628 of the spoon 626 engages a complimentary elongated edge 711 along the collet releasing sub 709, while a lower inwardly protruding shoulder 729 on the spoon 626 engages a companion shoulder 712 on the sub 709. A longitudinally extending inwardly facing surface 630 on the spoon 626 engages its complimentary surface 706 along the shear sleeve 705. The arrangement described above securely affixes the spoon 626 between the collet releasing sub 709 and the shear sleeve 705 such that the collet 624 and its interrelated parts are securely affixed to the plug assembly 700 therebelow.

A liner cementing plug assembly 700 (FIGS. 7H, 7I, 16, 23 and 24) is provided below the swab cup assembly 600 for wiping the inner diameter of the liner free of cement as the cementing plug assembly 700 travels from its secured position on the running tool RT downwardly through the well when pressure is exerted upon the drill pipe cementing plug assembly 1000 and causes disengagement of the assembly 700 from the lower end of the running tool RT, as will be hereinafter described. The plug assembly 700 contains a hosing exteriorly carrying a wiper plug element 723, and, in turn, comprises a longitudinally extending wiper plug mandrel 701 having at its upper end a collet releasing sub 709 to which is ineriorly affixed a shear sleeve element 702. Immediately below the wiper plug mandrel 701 is an elongated wiper plug nose 730 secured to he wiper plug mandrel 701 by means of threads 729, the nose 730 forming the lower portion of the housing for the plug element 723. The releasing sub 709 is secured to the wiper mandrel 701 by means of threads 722. The shear sleeve 702 is securely affixed to the releasing sub 709 by means of a plurality of shear pin elements 719 extending through bores 720 defined within the releasing sub 709 and the shear sleeve 702. An elastomeric seal element 717 is provied within its companion grooveway 718 within the lowermost section 713 of the shear sleeve 702 to prevent fluid communication between the sleeve 702 and the collet releasing sub 709. A fluid passageway 708 is provided within the collet releasing sub 709 immediately above the shear pins 719 for fluid commjincation through a complimentary fluid pasageway 707 within the shear sleeve 702 and immdiately above the lower end 713 thereof, these passageways 708 and 707 providing means for equalizing pressure in the annular area $A^5$ between the plug assembly 700 and the inner mechanism 900 of the hanger H, and the annulus $A^4$ within the running tool RT.

As described above, the collet releasing sub 709 provides surfaces 710, 711 and 712 thereon for engagement with companion edges 627, 628 and 629, respectively, along the spoon 626 of the collet element 624. The shear sleeve 702 has on its upper end 705 a longitudinally extending outwardly facing smooth surfac 706 for interface with an inwardly facing longitudinally extending surface 630 on the spoon 626 of the collet 624. The upper end 705 also has within a grooveway 703 a circumferentially extending elastomeric seal member 704 extending around the exterior and lower end of the swab cup mandrel 601 in order to prevent fluid communication between the swab cup mandrel 601 and the shear sleeve 702.

The wiper plug element 723 extending longitudinally along the exterior and protruding outwardly away from the wiper plug mandrel 701 is elastomeric in nature and provides upper and lower end wiper seals 724 and 725, respectively. Additionally, wiper elements 726, 727 and 728 are secured between the upper and lower members 724 and 725 for additional wiping of the inner mechanism 900 of the hanger H as well as the interior of the liner L below the hanger H when the assembly 700 travels downwardly within the liner L. Each elastomeric wiper element has an outer diameter in excess of the inner diameter of the liner L and the inner members 900 of the hanger H, such that longitudinally downward movement of the plug assembly 700 will cause the rubber-like elements 724, 725, 726, 727 and 728 to wipe the inner diameter of the liner L and the members 900 clean of cement and contaminant during cementing of the liner L.

Below the wiper element 723 is a seal sleeve 731 which engages the lower end 723A of the wiper assembly 723 and the lower end 701A of the mandrel 701. An elastomeric seal ring 734 is provided within its grooveway 735 in the seal sleeve 731 for engagement around the wiper plug nose 730 to prevent fluid communication between the wiper plug nose 730 and the seal sleeve 731. Additionally, there is a grooveway 732 within the seal sleeve 731 carrying an elastomeric seal element 733 which will, upon release of the wiper plug assembly 700 from the swab cup assembly 600, seal along a companion surface 1032 on an interiorly protruding inner collar sleeve 1027 in the landing collar LC immediately above the float shoe FS to prevent fluid communication between the seal sleeve 731 and the inner collar sleeve 1027.

Immediately below the seal sleeve 731 and carried around the lowermost portion of the wiper plug nose 730 is a wiper plug locking ring 736 which is made up as a snap ring which shifts latitudinally to overcome resistance to downward longitudinal movement to provide entry of the wiper plug assembly 700 into the bore of the landing collar LC to lock the wiper plug assembly 700 and the drill pipe cementing plug assembly 1000 into the landing collar LC above the float shoe FS for prevention of backflow of cement into the interior of the liner L when pump pressure is bled off. Accordingly, the cementing plug assembly 1000 and the wiper plug assembly 700 are affixed within the landing collar LC after pumping of the cement slurry into the well such that a pressure build-up indicated at the top of the well W means that all of the cement has been displaced from the interior of liner L, as described below.

The wiper plug nose 730 has at the lower end thereof an inwardly extending beveled surface 737 for sliding along a complimentary outwardly beveled surface 1031 of the landing collar LC as the assembly 700 travels within the landing collar LC.

The shear sleeve 702 is caused to be released from its affixed position with respect to the collet releasing sub 709 upon engagement of the cement plug assembly 1000 (FIGS. 21, 22, 23 and 24). As pressure is exerted on the cementing plug assembly 1000, the shear ring 702 is urged downwardly along its outwardly and upwardly extending beveled shoulder 702A as the result of the interface at 702A between the ring 702 and a seal sleeve 1017 of the cementing plug assembly 1000. As the cementing plug assembly 1000 is urged downwardly, the force encountered by the shear sleeve 702 through the shoulder 702A overcomes the strength of the shear pins 719, causing the shear pins 719 to shear longitudinally and permit the shear sleeve 702 to travel downwardly within a bore 716A defined by upper shoulder 715 on the lower end of the sub 709, the longitudinal wall 716 on the sub 709, and the lower shoulder 714 of the sleeve 702, until the lowermost end 714 of the shear sleeve 702 is placed immediately upwardly of the shoulder 715 on the collet releasing sub 709, this position preventing further downward travel of the shear sleeve 702. As the shear sleeve 702 travels downwardly, the uppermost end 705 of the shear sleeve 702 passes downwardly beyond the surface 630 on the spoon 626 of the collet mechanism 624, whereby the finger-like elements 625 of the collet 624 are caused to be flexed inwardly, and the wiper plug assembly 700 is freed from securement to the swab cup assembly 600.

The hanger assembly H basically is comprised of a hanger outer assembly 800 and a hanger inner mechanism 900, the inner mechanism 900 and the outer assembly 800 both being permanently left in the well after retrieval of the running tool RT. The hanger outer assembly 800 (FIGS. 7C, 7E, 7F, 7G, 7H, 12, 13, 14, 15, 17B, 17D, 17E, 25 and 26) has at the top thereof a tie back sleeve 801 longitudinally extending from the outermost portion of the spoon element 408 of the collet 401. A longitudinally inwardly extending surface 803 on the sleeve 801 interfaces with the longitudinally extending outer surface 310 of the spoon 408 when the sleeve 801 and the spoon 408 are in engaged position. Additionally, the sleeve 801 provides an inwardly protruding inwardly beveled shoulder 802 which is engaged by the downwardly and outwardly extending beveled shoulder 409 on the spoon 408. Thus, the running tool RT is engaged to the hanger H at the interface of the spoon 408 and the mandrel member 801. Additionally, it should be noted that the running tool RT also is affixed to the hanger H by means of threaded affixation of the floating nut 418 on the setting sleeve 903 whereby the setting sleeve 903 is connected to the body 413 of the running tool RT.

The lowermost end of the tie back sleeve 801 is affixed by threads 804 to a spline sleeve member 805 having therein a plurality of longitudinally extending slots 806 for respective housing of a plurality of longitudinally shiftable spline pin members 907 therein, the spline pin members 907 forming a part of the inner mechanism 900 of the hanger H described below to permit unitized rotation of the inner mechanism 900 and the outer assembly 800 as well as to enable the inner mechanism 900 to shift longitudinally with respect to the outer assembly 800. Additionally, the engagement of the pins 907 along the upper shoulder 806A of the slots 806 permits the weight of the hanger outer assembly 800 to be transmitted therethrough and thus relieves the carriages 206 from the burden of carrying this hanger weight and drag block friction, when the drill pipe DP is picked up. The spline sleeve 805 has a solid circumferentially extending bottom end 807 which terminates the lowermost portion of the longitudinal slot 806 and provides a means for housing and incapsulation of cap screw members 808 and 809 within their respective bores 810 and 811, the cap screws 808 and 809 securely affixing a series of longitudinally extending ring strap members 812 to the bottom end 807.

The ring straps 812 extend downwardly from the end 807 to a carriage ring 820 and, in combination with a lower set of ring straps 812A, serve to secure the carriage ring 820 to the hanger outer mechanism 800. The ring strap members 812 extend downwardly from the bottom end 807 of the spline sleeve 805 and through respective longitudinally extending passages 910 between circumferentially extending conical pads 909A on the liner hanger body 901. The passages 910 between the conical pads 909A for the ring straps 812 also define a fluid flow way for transmission of fluid between the hanger H and the casing C during running of the hanger H in the well bore W as well as during the cementing operation. The ring straps 812 continue downwardly between the conical pads 909A and within and through a receiving passage 813A in the first or upper set of circumferentially extending slip elements 813, the ring straps 812 being secured to the carriage ring 820 by means of screw cap members 821 and 823 housed within bores 822 and 824.

The first or upper set of circumferentially extending slip elements 813 has outwardly extending teeth 814 protruding therefrom with downwardly facing beveled edges 814A. When the slips 813 are exerted outwardly and contact the inner wall of the casing C, the teeth 814 engage along the casing wall such that further longitudinal downward movement of the hanger H within the casing C is prevented.

The cap screws 815 and 818 secure to the lower end of the slips 813 a plurality of longitudinally extending slip straps 817 carried below the slips 813, each slip strap 817 being interspaced circumferentially between each ring strap 812. The slip straps 817 secure the slips 813 to the carriage ring 820 therebelow.

The slip straps 817 are carried below the slips 813 and are secured by means of cap screws 821A and 823A within their bores 822A and 824A on the carriage ring 820 extending exteriorly around the liner hanger body 901.

A second series of longitudinally extending ring straps 812A is secured at its upper end to the lowermost portion of the carriage ring 820 by means of cap screws 825 and 827 carried within bores 826 and 828 within the carriage ring 820, the second series of ring straps 812A continuing downwardly between a second set of conical pads 915A and through a passageway 917 therefor. The ring straps 812A continue downwardly and exteriorly between the lower slips 829 and are terminally secured to a lower ring 841 extending exteriorly around the liner hanger body 901 by means of cap screws 835 and 836 extending therethrough and within respective bores 835A and 836A.

The lower cap screws 831 and 833 within their bores 831A and 833A serve to secure a second or lower set of slip straps 817A to the second or lower set of slips 829, each of the lower slip straps 817A and lower ring straps 812A being spaced between one another therebelow. The lower slip straps 817A are secured within the lower ring 841 by means of cap screws 838 and 839 housed within their respective bores 838A and 839A through the straps 817A. A downwardly extending tail 840 is engaged on and below the lower ring 841 and terminates the lower end of the ring 841.

The lower slips 829 are identical in function and construction as the upper slips 814, and have outwardly protruding teeth 830 for engagement along the interior of the casing C when the beveled shoulder 916 on the lower pads 915A slids along the inner wall 829A of the slips 829 to urge the slips 829 outwardly.

The inner mechanism 900 of the hanger H is basically comprised of an inner liner hanger body 901 which carries a series of circumferentially extending beveled conical pad members 909A and 915A. Upon longitudinal upward movement of the running tool RT, the pad members 909A and 915A urge slip elements 813 and 829, respectively, into engagement with the casing C and are maintained in this engaged position thereafter to assure continued anchoring of the hanger H on the casing C.

The inner mechanism 900 has affixed to the body 901 at its upper end by means of threads 902 a longitudinally extending setting sleeve element 903 having an uppermost end 906 which shoulders on the beveled ring 426 carried by the running tool body 413 for transmission of load and for facilitating releasing of the running tool RT from the hanger H. A circumferentially extending elastomeric seal element 904 is carried within its respective grooveway 905 defined within the setting sleeve 903 to prevent fluid communication between the setting sleeve 903 and the mandrel connecting sub 801.

The liner hanger body 901 also has affixed thereon by means of threads 908 a series of outwardly protruding spline pins 907 which respectively project into companion longitudinally extending slots 806 along with spline sleeve 805. As stated above, the spline pins 907 prevent rotation of the outer assembly 800 of the hanger H with respect to the inner assembly 900, and, because the pins 907 are free to travel longitudinally within the slots 806, the outer assembly 800 can slide longitudinally with respect to the inner assembly 900.

The bottom end of the spline sleeve 807 contacts, but is not affixed to, the liner hanger body 901 along the area 912 of the liner hanger body 901.

Below the area 912 on the liner hanger body 901 is a first series of circumferentially extending conical pad elements 909A affixed by welds 909B onto the circumferentially extending member 901. Each pad element 909A has longitudinally extending therebetween a passageway 910 for housing of the ring strap members 812 therethrough. Additionally, the conical pads 909A each have a lowerly beveled smooth shoulder 911 which, upon longitudinal shifting of the inner body 901, contacts a companion surface 813A along the innermost portion of the first or upper cone elements 813 such that continued longitudinal travel of the inner body 901 causes substantially complete interface between 911 and 813A to urge the slip elements 813 outwardly and away from the inner assembly 900 and toward the wall of the casing C for engagement along the interior of the casing C, and thereafter prevent further downward movement of the hanger H in the well W.

The liner hanger body 901 continues below the conical pads 909A and provides an area 913 for contact with, but not engagement of, the first or upper set of circumferentially extending slip elements 813. Additionally, along the area 914, the liner hanger body 901 contacts the carriage ring 820 extending exteriorly thereof.

A second set of conical pads 915A circumferentially extending around the liner body 901 is provided immediately below the carriage ring 820, each pad 915A having therebetween a longitudinally extending passageway 917 to permit insertion of the ring straps 812A therethrough. Each of the second or lower conical pads 915A also contains a lowerly beveled shoulder 916 which, upon downward shifting of the liner hanger body 901, causes the shoulder 916 of the pads 915A to communicate with the companion shoulder 829A extending on the upper and inner surface of the second or lower set of circumferentially extending slips 829 such that an interface of the surfaces 916 and 829A causes the second or lower slip elements 829 to extend latitudinally outwardly and away from the liner hanger body 901 and toward the wall of the casing C to permit the protruding teeth elements 830 of the slips 829 to engage along the wall of the casing C and thus prevent further longitudinal downward movement of the hanger H. The second or lower set of circumferentially extending slip elements 829 contacts, but is not engaged to, the liner hanger body 901 along the area 918. Additionally, the lowermost ring 841 contacts, but is not engaged to, the liner hanger body 901 along the area 919.

Figure 25:
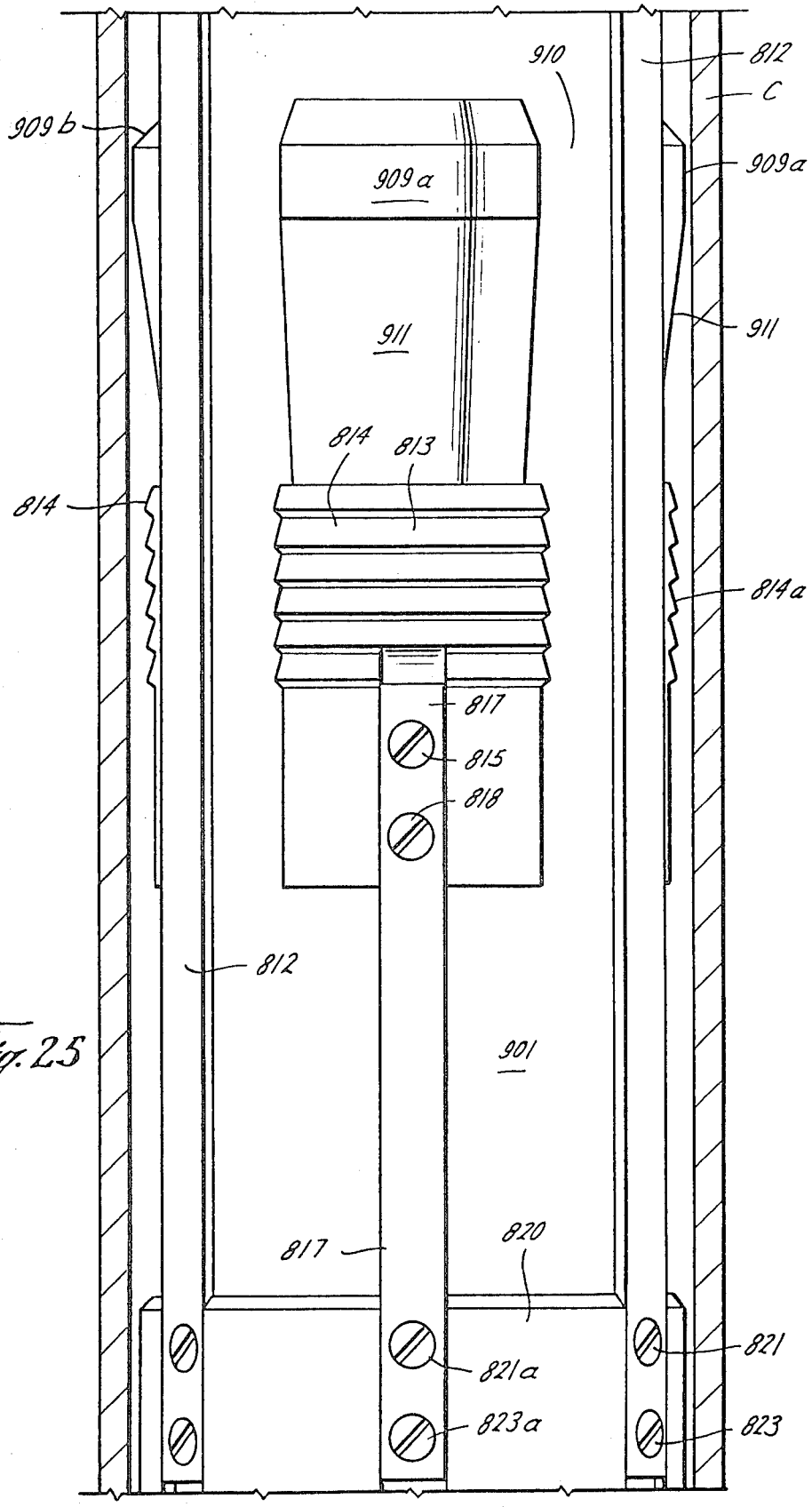
FIG. 25 is a latitudinally partial exterior elevational view illustrating the upper set of conical pad members in association with the upper slips prior to setting of the slips onto the casing, FIG. 25 being a view taken along lines 25—25 of FIG. 7F.
Figure 26:
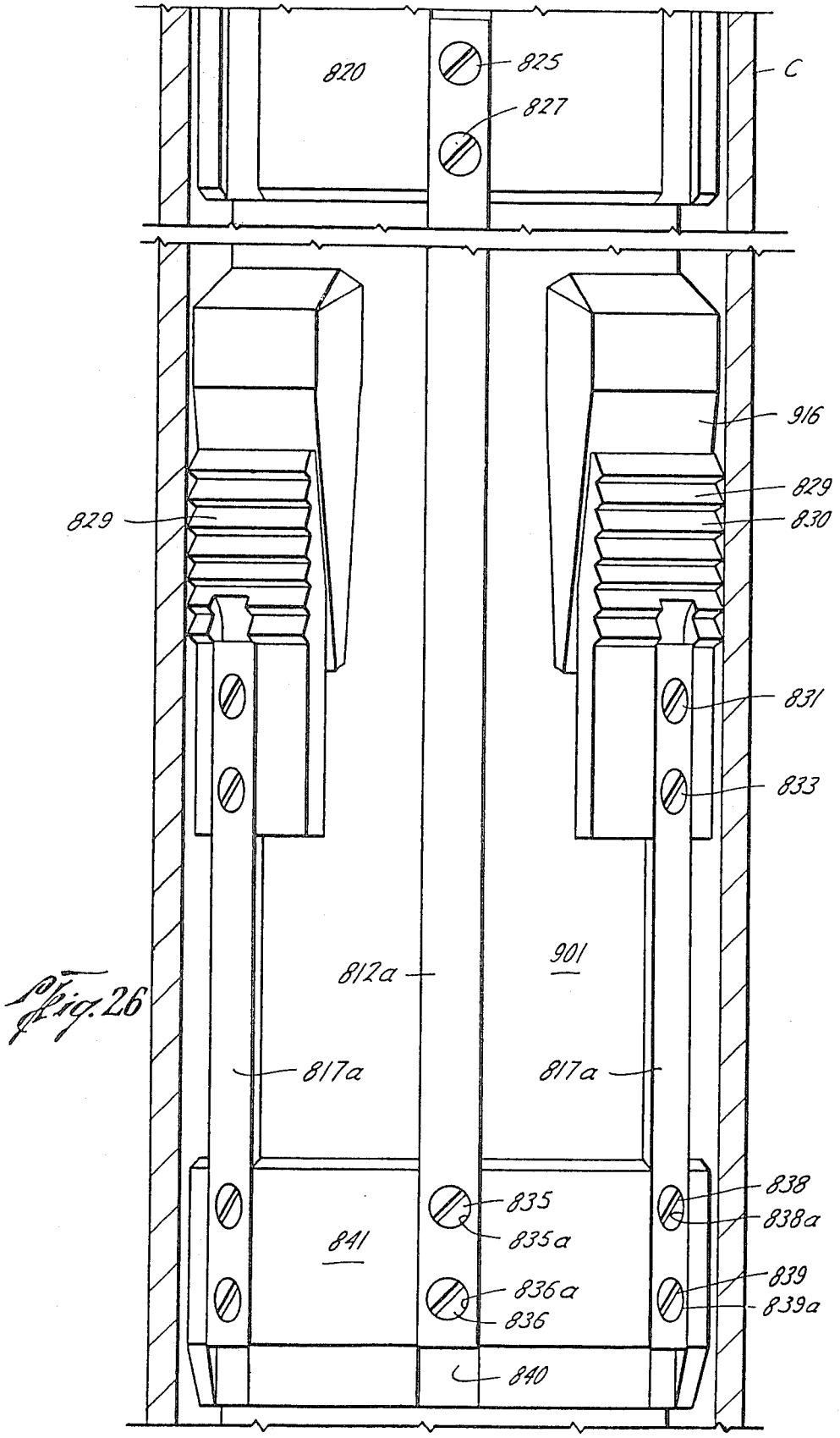
FIG. 26 is a view similar to that shown in FIG. 25 taken along lines 26—26 of FIG. 17E, illustrating the position of the lower conical pads in relation to the respective slip elements, the slip elements being in gripping or engaged position onto the casing.

As shown in FIGS. 25 and 26, the upper and lower pad members 909A and 915A are in circumferential interalignment along the inner body 901. Correspondingly, the upper and lower slip elements 814 and 829 also are in circumferential interalignment with respect to one another. Accordingly, the interalignment of the conical pads 909A and 915A and the slips 814 and 928 assures maximum weight carrying capacity for the hanger H.

The liner hanger body 901 has outwardly extending therefrom and below the lowermost ring 841 a lower gauge ring 920 which is a companion gauge ring for the gauge ring 103 affixed to the exterior of the top sub 101. The lower gauge ring 920 is affixed to the liner hanger inner body 901 by means of welds 921 and 922. The lower gauge ring 920 has an outwardly protruding smooth outer surface 923 which serves to off-set the hanger H from the casing wall C and to shield the outer mechanism 800 of the hanger H during rotational and longitudinal movement of the hanger H.

At the bottom of the liner hanger housing 901 are thread members 926 for threading at the end 925 of the body 901 of a section of liner L, which will extend therefrom and communicate to the bottom of the well bore.

Although not an integrable part of the running tool RT or the hanger H, but, nevertheless, a functional element in the cementing operation conducted subsequent to the setting of the hanger H and release of the running tool RT, is a drill pipe cementing plug assembly 1000 (FIGS. 7J, 21, 23 and 24), which is pumped down the drill pipe DP and the interior $A^3$ of the running tool RT behind the cement slurry used to cement the liner L into the well bore and in front of drilling fluid or mud used to thereafter displace the cement from within the liner L. The drill pipe cementing plug assembly 1000 has a longitudinally extending mandrel 1001 connected by threads 1003 at its lower end to a dropping plug 1002 extending therebelow. Immediately above the mandrel 1001 is a retainer element 1005 connected by threads 1004 to the sub 1001. The retainer element 1005 has a lowerly extending beveled end 1006 which houses a complimentary upwardly beveled end 1007 of an elastomeric wiper element 1008 longitudinally extending outwardly around the mandrel 1001. The wiper element 1008 is securely housed at its lowermost end by means of a circumferentially extending ring 1014 which engages the end 1013 of the plug element 1008.

The elastomeric plug element 1008 has a series of outwardly protruding and circumferentially extending elastomeric lip elements 1009, 1010, 1011 and 1012 for wiping cement away from the interior of the running tool RT and the drill pipe DP. Each of the lips 1009, 1010, 1011 and 1012 has an outer diameter slightly in excess of the inner diameter of the running tool RT and the drill pipe DP such that downward longitudinal movement of the drill pipe cementing plug assembly 1000 will cause each of the lips to efficiently wipe the inner surface of the running tool RT and the drill pipe DP, thereby removing cement which may have become affixed thereon during the cementing operation. Immediately below the ring 1014 and within the dropping plug 1002 is a longitudinally extending seal sleeve member 1017 threadedly secured to the dropping plug 1002 by means of threads 1023. Additionally, a similar circumferentially extending elastomeric seal ring 1020 is carried within a grooveway 1021 defined on the seal sleeve 1017 to prevent fluid communication between the seal sleeve 1017 and the element 713 of the collet releasing sub 709 when the seal sleeve 1017 is in engagement adjacent the shear sleeve 702. The seal sleeve 1017 also has circumferentially extending elastomeric seal ring member 1018 extending within a grooveway 1019 defined within the sleeve 1017 to prevent fluid communication between the seal sleeve 1017 and the central portion of the collet releasing sub 702 above the equalizing port 707. Below the seal sleeve 1017 and carried circumferentially and outwardly around the dropping plug 1002 is a locking ring element 1022 for engagement of the drill pipe cementing assembly 1000 and the wiper plug assembly 700, to thereafter prevent upward travel of the assembly 1000.

As the drill pipe cementing assembly 1000 is pumped through the interior of the drill pipe DP and into the running tool RT of the hanger assembly H after injection of the cement slurry and before injection of the drilling mud or fluid, the drill pipe cementing plug assembly 1000 will be prevented from further longitudinal downward movement within the running tool RT by the resistance afforded by the outwardly extending surface 702A on the collet releasing sub 702. As pressure is increased within the drill pipe DP during the pumping of the drilling fluid, the strength of the shear in 719 will be overcome, and the releasing sub 702 will slide longitudinally downward, thus permitting the spoon 626 to be released from its entrapped position and permitting the entire drill pipe cementing plus assembly 1000 and the plug assembly 700 to become an integrable mechanism which is pumped down through the liner L until the combined assemblies 700 and 1000 are inserted within the landing collar LC immediately above the float shoe FS at the bottom of the liner L.

The landing collar LC, not being a part of the hanger assembly H or the running tool RT, but, nevertheless, functional in the hydraulic setting of the hanger H and in the operation of the cementing method as described below is comprised of an outer housing 1025 to which is affixed by threads 1026 a landing collar element 1027. The landing collar element 1027 has a circumferentially extending elastomeric seal ring element 1028 housed within a companion grooveway 1029 on the collar element 1027 to prevent fluid communication between the element 1027 and the housing 1025. Additionally, the landing collar element 1027 provides an upward and inwardly beveled smooth surface 1030 for shifting of the element 737 of the wiper plug 730 when it is pumped down within the landing collar assembly LC such that the locking ring 736 is engaged immediately below the surface 1032, and the protrusion 731 on the seal sleeve is caused to be engaged by the beveled surface 1031 of the landing collar part 1027. The circumferentially extending O-ring 733 within its grooveway 732 prevents fluid communication between the seal sleeve 731 and the landing collar element 1027.

Figure 7J:
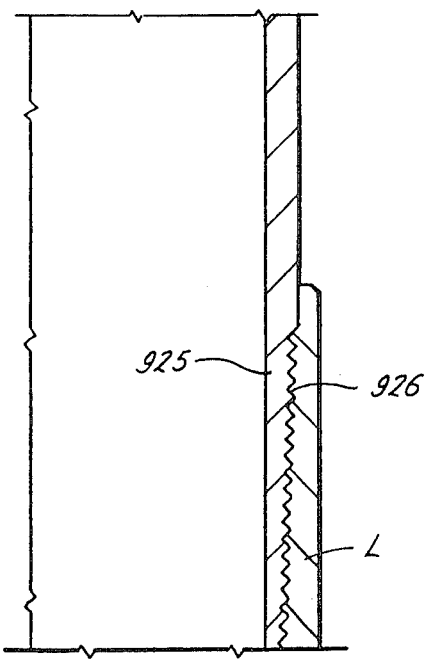
Figure 7J:
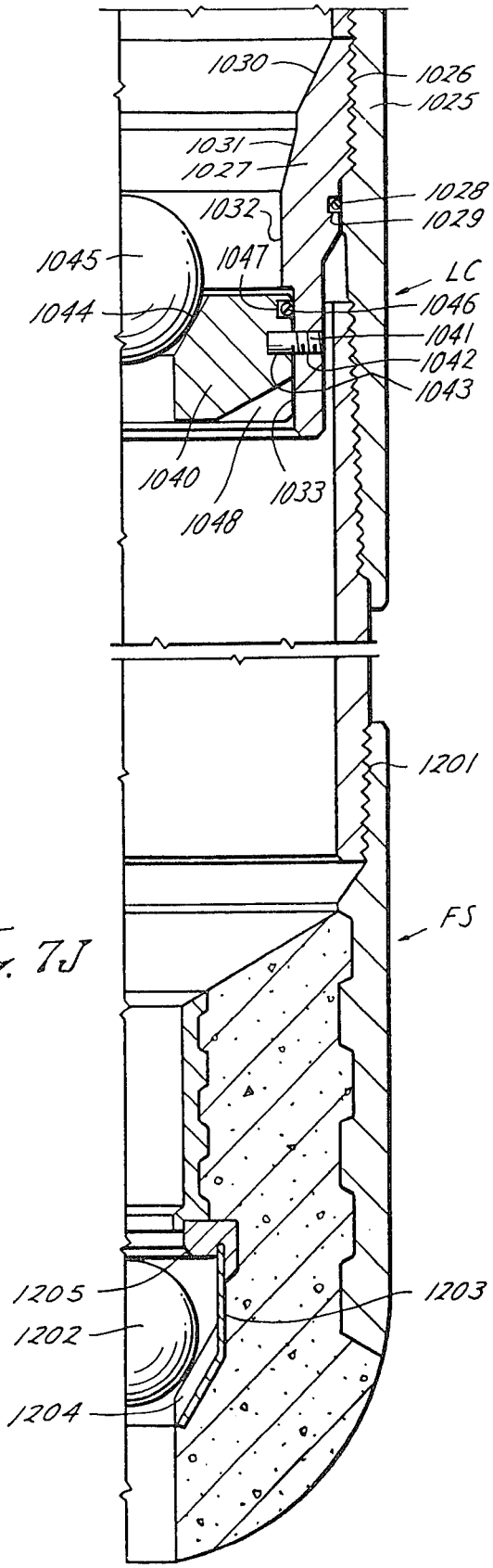
Figure 27:
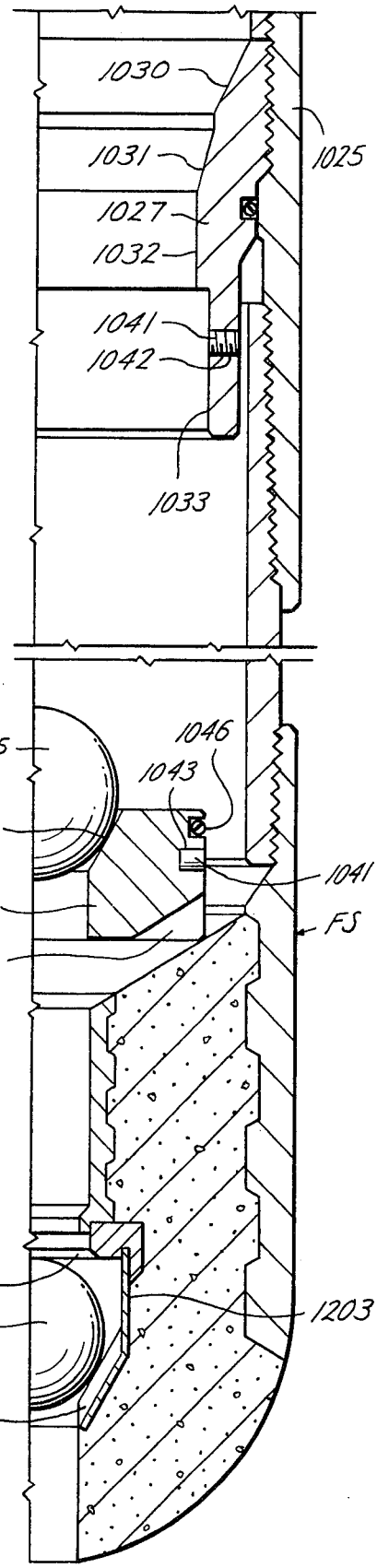
FIG. 27 is a view similar to that shown in FIG. 7 illustrating the position of the ball seat on the float shoe after setting of the hanger.
Figure 20A:
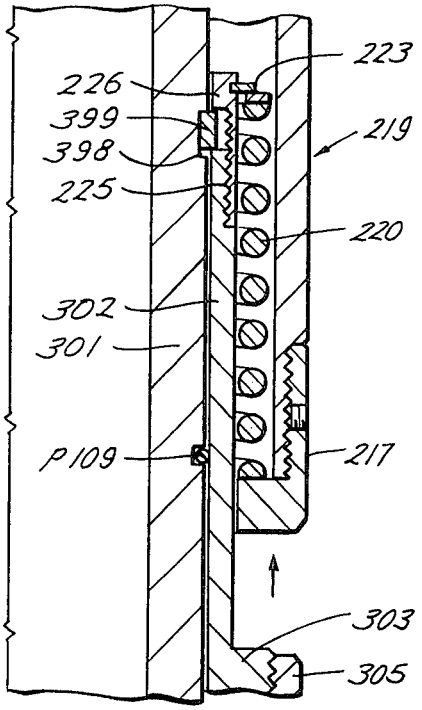
FIG. 20A is a partial longitudinal sectional view of the running tool in the position as shown in FIG. 20 with the mandrel and drag block housing being interengaged at a lock ring and groove.

As shown in FIGS. 7J and 27, the landing collar LC also receives a shearable seat member 1040 secured to the element 1027 by means of a threaded shear pin 1041 inserted through a bore 1042 within the element 1027 and received within a bore 1043 within the seat 1040. The seat 1040 provides a ball seat 1044 thereon for receipt of a ball 1045 which is inserted through the interior of the running tool RT, the hanger H, and the liner L when the liner L is at the desired depth in the well for hydraulic setting. An O-ring 1046 within a groove 1047 prevents fluid communication between the seat 1040 and the element 1027.

The seat 1040 is releasable from the element 1027 when pressure above the seat 1040 and within the liner L overcomes the shear strength of the shear pin 1041, at which time the pin 1041 breaks, and the seal 1040 free falls and lands on the top of the float shoe FS (FIG. 27). Fluid is permitted to be pumped around the seat 1040 and into the float shoe FS, as described below.

Below the landing collar LC and affixed thereto by means of threads 1201 is a float shoe FS carrying therein a ball element 1202 which is housed within a ball seat 1203 having ports 1204 therein, such that fluid may be transmitted through the drill pipe DP and the liner L, and thence through the float shoe FS and pass outwardly through the ports 1204 and thence within the annular area between the liner L and the casing C. However, because of the ball seal 1205 within the ball seat 1203 and above the ball 1202, fluid within the bore of the well W is prevented from passing within and upwardly through the float shoe FS and subsequently through the liner L because the ball 1202 will be caused to become sealingly engaged upon the ball seal 1205.

OPERATION

The hanger H and the running tool RT are run as a unit into the bore of the well W and within the casing C. The upper end of the desired length of liner L to be hung within the well W below the hanger H is secured to the end 925 of the inner assembly 900 of the hanger H by means of threads 926. The inner mechanism 900 of the hanger H is affixed to the running tool RT by means of the floating nut 418 which is threaded to the setting sleeve 903 by means of left-hand threads 424. The floating nut 418 receives the longitudinally extending splineways 420 within its central bore 419. In this portion, the lower end 423 of the floating nut 418 rests securely on the upper end 422 of the stinger 414.

The hanger outer assembly 800 is affixed to the running tool RT by engagement of the spoon 408 between the mandrel connecting sub 412 and the liner tie back sleeve 801. Accordingly, the inner mechanism 800, the outer assembly 800, and the releasing mechanism 400 are secured together for initial running of the running tool RT and the hanger H within the well.

The outer assembly 800 of the hanger H is carried longitudinally along and outwardly from the inner mechanism 900. Although the inner mechanism 900 and the outer assembly 800 are not assembled as a single unit, they are, nevertheless, operably inter-related by, for example, the spline pins 907 of the inner mechanism 900 being carried within the longitudinal slot 806 of the outer assembly 800, and the straps 812 and 812A of the outer assembly 800 being carried within the passageways 910 and 917 between the conical pads 909A and 915A of the inner mechanism 900.

It should be noted that the inner mechanism 900 of the hanger H is free to slide longitudinally both upwardly and downwardly with respect to the outer assembly 800 of the hanger H, but rotational movement between the inner mechanism 900 and the outer assembly 800 is prevented by the positioning of the spline pins 907 on the liner hanger body 901 within their respective longitudinally extending slots 806 within the spline sleeve 805 of the outer assembly 800.

The upper end of the running tool RT is connected to a string of drill pipe DP thereabove by means of threads 102.

Relative longitudinal movement between the top sub 101 and the mandrels 301 and 105 of the running tool RT in relation to the outer assembly 800 of the hanger H is controlled by the outer housing or sleeve 201 for the "J" pins 203 being hald firmly against the drag block housing 302 of the drag block assembly 300 by means of the spring 220 together with the carriage portions 206 of the "J" pins 203 riding in the "J" slot defined by the shoulders 214 and 215 and being secured in place by the shear pins 280. The force of the spring element 220 provides sufficient friction between the outer housing 201 and the drag block housing 302 so that the drag block housing 302 and the outer housing or sleeve 201 will rotate as a unit in the event that the carriage elements 206 are mechanically shifted within the "J" slot 202 during rotation to the right of the drill pipe DP.

While the running tool RT and the hanger H are lowered into the bore of the well W within the casing C, the drag block members 307 afford resistance to longitudinal and rotational movement and the spring 220 will hold the drag block housing 302 and the outer housing 201 in the relative position shown in FIGS. 17A and 17B while the running tool RT and the hanger H continue travel downwardly within the bore of the well W.

In the event that the drill pipe DP is picked up for any reason, for example, to upwardly relocate in the well at another depth the running tool RT and the hanger H, the outer housing 201 and the drag block housing 302 of the running tool RT will remain stationary with respect to the casing C because the carriage elements 206 are connected to the outer housing 201 by the shear 201 down firmly against the drag block housing 302 during the relative positioning of the carriages 206 within the "J" slot 202.

when it is desired to set the liner L within the bore of the well W at the predetermined depth, the ball 1045 is dropped at the top of the well W through the running tool RT, the hanger H and the liner L until it is sealing engaged onto its seat 1040. Thereafter, pressure is applied and increased within the drill pipe DP and enters the piston chamber PC through the port P301. As pressure is increased above well pressure, the differential pressure within the piston chamber PC of the piston P102 causes the outer housing 201, the drag block retainer ring 305, the drag block housing 302, the collet 401 and the outer assembly 800 to be shifted upwardly. Consequently, upward force is transmitted through the drag block assembly 300, the hanger outer assembly 800 and the running tool outer housing 201 until the strength of the shear pins 280 is overcome. At such time, the pins 280 shear and permit the carriages 206 to travel longitudinally upwardly within the long slot defined by the shoulders 215 and 214. Accordingly, movement of the carriages 206 causes telescopic movement of the outer housing 201, the drag block assembly 300, the collet 401, and the outer mechanism 800 of the hanger H, with respect to the inner mechanism 900 of the hanger H and the inner members 301, 412, 105, etc., of the running tool RT.

During the telescopic interaction between the inner members defined above, and the outer members 201, 302 and 401 of the running tool RT and the hanger outer members 800, the longitudinal movement of the inner mechanism 900 causes the upper and lower slips 813 and 829, respectively, to be shifted longitudinally with respect to the stationary inner mechanism 900 of the hanger H, such that the inner beveled shoulders 813A and 829A of the upper and lower slip members 813 and 829, respectively, receive the shoulders 911 and 916 of the pads 909A and 915A. As the slips continue upward movement, the upward and outwardly extending bevel of the surfaces 911 and 916 will cause the slip elements 813 and 829, respectively, to be urged outwardly and away from the inner mechanism 900 of the hanger H until resistance is afforded to outer extension of the slips 813 and 829 by means of contact of the teeth 814 and 830 on the upper and lower slips 813 and 829, respectively, with the inner wall of the casing C. Thus, the inner wall of the casing C interfaces with the teeth 814 and 829 of the upper and lower slips 813 and 829, respectively, and the slips 813 and 829 are held in the outwardly extended position, this locking position being secured by the permanent engagement of the inner surfaces 813A and 829A of each of the upper and lower slip elements 813 and 829 with respect to the beveled shoulders 911 and 916 of the upper and lower conical pads 909A and 915A.

If it is desired to mechanically set the hanger H, the shear pins 280 are removed from the running tool RT before it is run into the well W. At the desired setting depth, the drill pipe DP is picked up so that the running RT and the hanger H are in the position as described above. Subsequently, the drill pipe DP is rotated to the right causing the carriage elements 206 of the "J" pins 203 to ride relatively along the cam way immediately above the lower end 211 of the slot 202 until resistance to right-hand travel is resisted by the carriage 206 encountering the side 212 of the slot 202. After a predetermined number of right-hand rotations of the drill pipe DP, the carriages 206 encounter the wall 212 and the drill pipe DP is set down and the carriages 206 will be relatively urged upwardly into the cam way defined by sides 212 and 213 of the "J" slot 202. The carriages 206 will continue relative upward longitudinal movement until they are relatively shifted within the cam way defined by walls 214 and 215. Accordingly, manipulation of the drill pipe DP causes telescopic movement of the outer housing 201, the drag block assembly 300, the collet 401, and the outer mechanism 800 of the hanger H, with respect to the inner mechanism 900 of the hanger H and the inner members 301, 412, 105, etc., of the running tool RT.

During the telescopic interaction between the inner members defined above, and the outer members 201, 302 and 401 of the running tool RT and the hanger outer members 800, the downward movement of the inner mechanism 900 causes the upper and lower conical pads 909A and 915A, respectively, to be shifted downwardly with respect to the stationary outer assembly 800 of the hanger H, such that the inner beveled shoulders 813A and 829A of the upper and lower slip members 813 and 829, respectively, receive the shoulders 911 and 916 of the pads 909A and 915A. As the pads continue downward movement, the upward and outwardly extending bevel of the surfaces 911 and 916 will cause the slip elements 813 and 829, respectively, to be urged outwardly and away from the inner mechanism 900 of the hanger H until resistance is afforded to outer extension of the slips 813 and 829n by means of contact of the teeth 814 and 830 on the upper and lower slips 813 and 829, respectively, with the inner wall of the casing C. Thus, the inner wall of the casing C interfaces with the teeth 814 and 829 of the upper and lower slips 813 and 829, respectively, and the slips 813 and 829 are held in the outwardly extended position, this locking position being secured by the permanent engagement of the inner surfaces 813A and 829A of each of the upper and lower slip elements 813 and 829 with respect to the beveled shoulders 911 and 916 of the upper and lower conical pads 909A and 915A.

The above described mechanical procedure may be utilized subsequent to shearing of the pins 280 in the event that insufficient pressure cannot be built up in the tool by hydraulic means to set the slips.

It should be noted that as the drill pipe DP is rotated to the right during the initial mechanical setting operation to cause relative travel between the carriage elements 206 of the "J" pins 203 and the end 211 of the "J" slots 202 as above described, the liner L and the hanger H are rotated to the right with the drill pipe DP because of the swiveling action afforded by means of the split retainer elements 403 and 404 connecting the collet member 401 to the drag block housing 302. Additionally, the outer assembly 800 and the inner mechanism 900 of the hanger H are permitted to rotate together as a unit to the right because of the positioning of the spline pins 907 within the longitudinal slots 806. The liner L connected to the bottom of the inner members 900 of the hanger H also must rotate to the right. However, the drag block housing 302 will remain stationary. If the drill pipe DP is inadvertently rotated to the right more than a sufficient amount of rotations required to move the carriage elements 206 with respect to the cam way 215 - 214 to the upper position 209 of the "J" slot 202, the outer housing 201 also will swivel to the right with respect to the drag block housing 302 immediately after the rotational friction afforded by the spring 220 is overcome. Longitudinal manipulation of the drill pipe DP will result in the collet 401 shifting longitudinally upwardly or downwardly along the connecting sub 412 but, because of the length of the connecting sub 412, the collet 401 and its spoon 408 will remain affixed upon the outer surface 412A of the mandrel connecting sub 412.

It should be noted that the positioning of the running tool RT and the hanger H as above described provides anchoring against longitudinal movement as well as rotational movement of the hanger H and the liner L within the bore of the well W. Accordingly application of torque to the drill pipe DP in conjunction with right-hand rotation of the drill pipe DP will cause the floating nut 418 to unscrew from its threads 424 along the setting sleeve 903 and permit the floating nut 418 to ride longitudinally upwardly along the splineways 420 of the setting tool body 413, with the splineways 420 carried within the longitudinally extending bore 419 of the floating nut 418, until such time as the floating nut 418 has become completely released from the threads 424 and the setting sleeve 903.

The bearing ring 428 resting on the lower end 429 of the setting tool body 413 will transfer drill pipe weight from the running tool RT to the inner mechanism 900 of the hanger H by means of the beveled ring 426 immediately below the bearing ring 428 and carried circumferentially around the outer area of the setting tool body 413. The bearing ring 428 also serves to minimize friction of any set-down weight that may be carried between the setting tool body 413 and the liner hanger body 901. Thus, the floating nut 418 may be moved out of engagement between the liner hanger body 901 and the setting tool body 413 and its mating threads 424 without any relative longitudinal movement between the running tool RT and the hanger H.

After a sufficient and known number of right-hand rotational turns of the drill pipe DP are completed, the drill pipe DP may be picked up. As the drill pipe DP is picked up, the inner body 100 of the running tool RT moves upwardly until the upper end 412A of the connecting sub 412 approaches the lower face 330 of the drag block assembly 300, at which time the snap ring 399 is released into locking engagement within the groove 398 to secure the mandrel 301 to the top sub 101. Concurrently, pressure within the chamber PC is vented through the passageways 113.

If the hanger H has been properly set in the bore of the well W along the wall of the casing C, and the floating nut 418 has completely cleared its threads 424 and has traveled upwardly along the splineways 420, a difference in drill pipe weight will be detected at the top of the well. Thereafter, the drill pipe DP is moved longitudinally upwardly and causes the carriage elements 206 of the "J" pins 203 to retrace their path from the upper or set position 209 within the "J" slots 202 downwardly along and with respect to the cam way defined by the sides 215 and 214 of the "J" slots 202 until further downward travel is resisted by the angle shoulder 216 of the island 208, whereby the carriages 206 are caused to shift slightly to the left for automatic alignment for re-entry into the cam way 210. Thereafter, the outer housing 201 may be carried upwardly with the top sub 101 and the drill pipe DP, and will thus cause compression of the spring 220. Continued upward travel of the drill pipe DP will cause the top sub 101, the upper mandrel 301 connected thereto, and the mandrel connection sub 412 to shift longitudinally upwardly with respect to the stationary collet 401 until the end of the mandrel connecting sub 412 approaches the lower end 330 of the drag block housing 302. The drag block assembly 300 will then move upward longitudinally with the mandrel connecting sub 412 and its interrelated parts as described above. As the drag block assembly 300 is moved longitudinally upwardly with the inner portions of the running tool RT, the upward force exerted through the drag block housing 302 and the collet 401 will, in combination with the upward repositioning of the mandrel connecting sub 412, force the fingers 407 of the collet 401 to collapse inwardly below the mandrel connecting sub 412 and become released from the holding surfaces 802 and 803 along the top of the mandrel connecting sub 801 to release the hanger H from the collet 401 and the running tool RT.

In the event that the running tool RT and the hanger H are run in the bore of a well which is deviated, a considerable amount of "drag" may be encountered on the drill pipe DP. Accordingly, it may be difficult to detect a change in weight on the drill pipe DP at the top of the well even when the running tool RT has been released from the hanger H. Thus, the side seal assembly 500 provides means for detecting at the top of the well the release of the running tool RT from the hanger H by means other than utilization of a weight indicator. If pressure is applied within the drill pipe-casing annulus immediately before the running tool RT is withdrawn from the hanger assembly H, the pressure will drop when the seal element 508 travels upwardly out of engagement in the interior $A^4$ above and past the shoulder 930 on the sleeve 903 because the interior $A^1$ above the shoulder 930 has a larger internal diameter than the internal diameter of the interior $A^4$. Thus, a presssure variance or drop will occur as the element 508 passes from within interior $A^4$ to within the interior $A^1$ and may produce a change in the apparent weight of the drill pipe DP. Thus, as soon as the side seal assembly 500 clears the bore in which it is in sealing engagement, the pressure will be equalized around the end of the running tool RT and into the drill pipe DP. A pressure variance should be noted at the top of the well W indicating that the liner hanger H is properly hung in position and that the running tool RT is released from the hanger H.

The running tool RT now is released from the hanger H but is not withdrawn from the bore of the well W. It has been run up a predetermined distance above the hanger H and remains in that position during the cementing operation, as described below.

Prior to initiation of the cementing operation, pressure within the drill pipe DP is increased sufficiently to cause shearing of the shear pin 1041 and release of the shear seat 1040 onto the top of the float shoe FS.

The cementing operation is initiated by pumping down within the drill pipe DP the preselected quantity and quality of cement slurry which passes through the interior $A^3$ of the running tool RT, within the top sub 101, thence through the interior of the upper mandrel 301 therebelow, the lower mandrel 105, the interior of the setting tool body 413, the tubing or stinger body 113, the swab cup mandrel 601, the wiper plug mandrel 701, thence through the liner L connected to the end 925 of the inner mechanism 900 of the hanger H. Thereafter, the cement slurry continues being pumped downwardly through the interior of the landing collar LC and then out of the ports 1204 of the float shoe FS affixed to the end of the liner L. The cement slurry flows around the bore defined between the casing C and the liner L and continues upwardly along the exterior of the liner L passing upwardly and immediate the hanger H. To assure proper cementing of the liner L and the hanger H within the bore of the well W, a sufficient amount of cement slurry is pumped above the depth of the setting of the liner L, for example, approximately 300 feet, or so.

After the cementing operation has been complete, the drill pipe cementing plug assembly 1000 is pumped within the drill pipe DP from the top of the well behind the cement slurry used tpo cement the liner L into the well bore and in front of drilling fluid or drilling mud which is used to thereafter displace the cement. As the drill pipe cementing plug assembly 1000 approaches the area of the wiper plug assembly 700, the locking ring 1022 along the lower end of the dropping plug 1002 encounters the shoulder 715A protruding outwardly from the upper end 715 on the collet releasing sub 709. As downward travel of the drill pipe cementing plug assembly 1000 is afforded by pressure applied to the drilling fluid being pumped within the drill pipe DP, the locking ring 1022 shifts contractually to permit the locking ring 1022 to pass longitudinally downwardly past the protrusion and end 715. After the locking ring 1022 has past beyond and below the protrusion 715A, the ring 1022 again is permitted to shift to its normal and running position outwardly on the dropping plug 1002. The outer and expanded position of the locking ring 1022 below the protrusion and end 715A, together with the engagement of the seal sleeve 1017 along the shoulder 702A of the shear sleeve 702 "locks" the drill pipe cementing plug assembly 1000 into place and prevents relative longitudinal movement between the drill pipe cementing plug assembly 1000 and the wiper plug assembly 700. However, continued resistance to downward movement of the drill pipe cementing plug assembly 1000 may be overcome by increased pressure within the drill pipe DP which will cause the shear pin 719 to shear, whereby the shear sleeve 702 of the wiper assembly 700 is shifted downwardly along the side 716 of the releasing sub 709. As the collet releasing sub 702 shifts longitudinally downwardly, the spoon 628 and the fingers 625 of the collet 624 are disengaged from locked position between the collet releasing sub 709 and the shear sleeve 702 such that that the fingers 625 of the collet 624 are permitted to flex inwardly and the collet releasing sub 709 travels downwardly together with the cementing plug assembly 1000 by means of the outwardly beveled shoulder 627 along the collet releasing sub 709 passing along the spoon 626. The wiper plug assembly 700 thus is disengaged from the running tool RT. Accordingly, the drill pipe cementing plug assembly 1000 and the wiper plug assembly 700 then may be pumped down the interior of the liner L together as a unit, with the wiper element 723 and its inter-related wiping sleeves 724, 725, 726, 727, and 728 removing cement which may have been affixed to the inner surface of the liner L. Additionally, the combined cementing plug assembly 1000 and the wiper plug assembly 700, now positioned above the cement slurry and below the drilling fluid, will prevent the mud from contaminating the cement.

The combined drill pipe cementing plug assembly 1000 and the plug assembly 700 continued downward travel within the interior of the liner L until the nose 737 of the wiper plug mandrel 701 encounters the side 1031 of the landing collar LC. When the nose 737 is in this position, the locking ring 736 protruding exteriorly around the nose 737 will slide along the beveled surface 1031 of the landing collar LC, the beveling of the surface 1031 causing the locking ring 736 to snap inwardly and pass along the lower portion of the side 1031, and will afford travel of the wiper plug mandrel 701 along and past the surface 1032 of the landing collar LC until the snap ring 736 lands within the lower side 1033 of the landing collar LC which has a larger internal diameter than that of the side 1032. Accordingly, the ring 736 will become engaged within the landing collar LC to prevent upward movement of the wiper plug mandrel 701. The circumferentially extending elastomeric seal 732 housed within its bore 733 within the seal sleeve 731 is engaged along the surface 1032 of the landing collar LC to prevent fluid communication between the seal sleeve 731 and the landing collar element 1027. Thus, in the event that pump pressure is bled off, cement will be prevented from flowing back into the liner L because of the sealing engagement of the drill pipe cementing plug assembly 1000 and the plug assembly 700 into the landing collar LC. This plug arrangement will act as a back-up plugging system to the float shoe FS to assure prevention of back flow into the liner L of cement in the event that the ball 1202 becomes inoperable for sealing engagement on its seat 1203. Additonally, this positioning of the drill pipe cementing plug assembly 1000 and the plug assembly 700 will permit a pressure build-up when the plugs 1000 and 700 seal within the landing collar LC, thus indicating at the top of the well that all of the cement has been displaced from the interior of the liner L.

Reverse circulation may be initiated to wash out cement within the casing-drill pipe annulus above the hanger H by pumping mud down this annulus and within the drill pipe DP through the end of the running tool RT, which previously has been positioned above the upper end of the hanger H.

Upon completion of the cementing operation as above described, the running tool RT, being earlier released from the hanger H, may be retrieved to the top of the well and reused by removing the drill pipe DP from the well, the running tool RT being affixed to the bottom of the drill pipe DP by means of threads 102 at the top of the top sub 101 of the running tool RT. Thereafter, the liner L may be pressure tested, perforated and production of hydrocarbons transmitted through the interior of the liner L and casing C to the top of the well.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is desired to be secured by Letters Patent is:

1. An apparatus for running, setting and anchoring a liner in a well bore casing, comprising: an inner longitudinally extending body; an outer longitudinally extending body around said inner body; connecting means on one of said inner and outer bodies for connection of a liner therebelow; expander means carried on one of said inner and outer bodies; gripping means carried on the other of said inner and outer bodies and engagable with said expander means whereby said gripping means are shifted into gripping engagement with said casing; a manipulatable tubular running tool releasably secured to said inner and outer bodies; drag means mounted on said running tool slidable longitudinally along said casing; means for selective disengagement of said running tool from said inner and outer bodies; and setting means responsive to each of fluid pressure and mechanical manipulation and carried on said running tool to longitudinally shift one of said inner and outer bodies with respect to the other of said inner and outer bodies to anchor said liner to said casing, said drag means resisting longitudinal travel of said apparatus while in said well bore with sufficient frictional force to support the weight of one of said inner and outer bodies therebelow and to afford operation of said setting means during response to mechanical manipulation.

2. The apparatus of claim 1 wherein said connecting means are on said inner longitudinally extending body.

3. The apparatus of claim 1 wherein said expander means are carried on said inner longitudinally extending body.

4. The apparatus of claim 1 wherein said gripping means are carried on said outer longitudinally extending body.

5. The apparatus of claim 1 wherein said drag means are mounted exteriorly around said running tool, said drag means resisting longitudinal travel of said apparatus while in said well bore with sufficient frictional force to support the weight of said outer longitudinally extending body.

6. The apparatus of claim 1 wherein said setting means carried on said running tool are responsive to each of fluid pressure and mechanical manipulation to longitudinally shift one of the inner and outer bodies with respect to the other of said inner and outer bodies.

7. The apparatus of claim 1 wherein said connecting means are carried on said inner longitudinally extending body; said expander means are carried on said inner longitudinally extending body; said gripping means ar carried on the outer longitudinally extending body; said drag means are mounted on said running tool and resisting longitudinal travel of said apparatus while in said well bore with sufficient frictional force to support the weight of said outer longitudinally extending body; and said setting means carried on said running toll are responsive to each of fluid pressure and mekchanical manipulation to longitudinally shift said outer body with respect to said inner body.

8. The apparatus of claim 1 wherein said gripping means carried on the other of said inner and outer bodies are engagable by said expander means whereby said gripping means are shifted into gripping engagement with said casing.

9. The apparatus of claim 1 wherein said expander means comprises conically-shaped pad elements spaced circumferentially around the exterior of one of said inner and outer longitudinally extending bodies.

10. The apparatus of claim 1 wherein said expander means comprises a plurality of longitudinally spaced sets of conically-shaped pad elements extending circumferentially around the exterior of one of said inner and outer longitudinally extending bodies.

11. The apparatus of claim 1 wherein said gripping means carried on one of said inner and outer longitudinally extending bodies includes a plurality of slip elements having outwardly protruding teeth members thereon for gripping engagement on said casing.

12. The apparatus of claim 1 wherein said gripping means comprises a plurality of slip elements circumferentially extending around the exterior of one of said inner and outer longitudinally extending bodies.

13. The apparatus of claim 1 wherein said gripping means comprises a plurality of longitudinally spaced sets of slip elements carried along the exterior of one of said inner and outer longitudinally extending bodies.

14. The apparatus of claim 1 wherein said gripping means are activatable into gripping engagement with said casing upon relative longitudinal upward movement of one of said inner and outer longitudinally extending bodies with respect to the other of said inner and outer longitudinally extending bodies.

15. The apparatus of claim 1 wherein said drag means mounted on said running tool comprises a plurality of drag block elements circumferentially spaced around the exterior of said running tool and having face members for direct contact with said casing.

16. The apparatus of claim 1 wheren said means for selective disengagement of said running tool from said inner and outer bodies comprises a collet assembly for selective engagement of one of said inner and outer longitudinally extending bodies, and means engagable with the other of said inner and outer longitudinally extending bodies and responsive to rotation of said running tool for disengagement of the running tool from the inner and outer longitudinally extending bodies.

17. The apparatus of claim 1 wherein said means for selective displacement of said running tool from said inner and outer bodies comprises a collet assembly carried on said running tool for selective engagement of one of said inner and outer longitudinally extending bodies with said running tool, and means on said running tool engagable with the other of said inner and outer longitudinally extending bodies and responsive to rotation of said running tool for disengagement of the running tool and said inner and outer bodies.

18. The apparatus of claim 1 wherein said means for selective disengagement of said running tool from said inner and outer bodies comprises a collet assembly on the running tool for selective engagement of one of said inner and outer longitudinally extending bodies with said running tool, and means on said running tool engagable with the other of said inner and outer bodies responsive to rotation of said running tool for disengagement of said running tool and said other of the inner and outer longitudinally extending bodies, said means on said running tool comprising a floating nut carried by said running tool and threadedly securable to said other of said inner and outer bodies.

19. The apparatus of claim 1 wherein the means for selective disengagement of said running tool from said inner and outer bodies comprises: a collet assembly on the running tool for selective engagement of one of said inner and outer longitudinally extending bodies; floating nut means carried on said running tool and threadedly securable to the other of said inner and outer longitudinally extending bodies, said floating nut means being responsive to rotation of said running tool for disengagement of the running tool and said other of the inner and outer bodies; and a splineway defined intermediate said running tool for longitudinal travel of said floating nut means upon rotation of said running tool to disengage said running tool from the said other of said inner and outer bodies.

20. The apparatus of claim 1 wherein said drag means mounted on said running tool comprises means for securement of one of said inner and outer bodies to said drag means for relative rotation of one of said inner and outer bodies with respect to said drag means.

21. The apparatus of claim 1 further comprising means for prevention of relative rotational movement between said inner and outer longitudinally extending bodies.

22. The apparatus of claim 1 further comprising means for prevention of relative rotational movement between said inner and outer longitudinally extending bodies, said rotational prevention means including spline pins carried on one of said inner and outer longitudinally extending bodies for engagement within longitudinally extending slotted means for said pins carried on the other of said inner and outer longitudinally extending bodies.

23. The apparatus of claim 1 further comprising means for prevention of relative rotational movement between said inner and outer longitudinally extending bodies, said rotation prevention means comprising spline pins carried on said inner longitudinally extending body for engagement within slotted means carried on said outer longitudinally extending body.

24. The apparatus of claim 1 further comprising: swab means on said running tool and slidable along the interior of one of said inner and outer longitudinally extending bodies to sealingly direct fluid within the interior of said liner; a liner wiper assembly selectively engagable to said running tool and slidable downwardly within and along the interior of said liner upon disengagement from said running tool; and collet and sleeve means engaging said wiper assembly to said running tool and operable to disengage said wiper assembly from said running tool.

25. The apparatus of claim 1 further comprising: a swab assembly affixed on said running tool and slidable along the interior of one of said inner and outer longitudinally extending bodies to sealingly direct fluid within the interior of said liner; and a liner wiper assembly selectively disengagable from said running tool and slidable downwardly within said liner upon disengagement from said apparatus, said wiper asssembly having sleeve means thereon shiftable longitudinally to release said wiper assembly from said running tool.

26. The apparatus of claim 1 further comprising: a swab assembly affixed to said running tool and slidable along the interior of one of said inner and outer longitudinally extending bodies to sealingly direct fluid within the interior of said liner; a liner wiper assembly selectively disengagable to said running tool and slidable downwardly within said liner upon disengagement from said running tool; and collet and sleeve means engaging said wiper assembly to said running tool and operable to disengage said wiper assembly from said running tool, said sleeve means providing a shoulder thereon for receipt of means thereon to urge said sleeve downwardly and release said collet to disengage said wiper assembly from said running tool.

27. The apparatus of claim 1 further comprising: a swab assembly affixed to said running tool and slidable along the interior of one of said inner and outer longitudinally extending bodies to sealingly direct fluid within the interior of said liner; a liner extending below and connected to one of said inner and outer longitudinally extending bodies, said liner carrying at its lowermost end: float shoe means for prevention of flow of fluid from the exterior of said liner to the interior thereof, but for permitting flow of fluid from the interior of said liner to the exterior thereof; and means on said liner for receipt of and releasable engagement with said wiper assembly upon longitudinal downward movement thereto of said wiper assembly.

28. The apparatus of claim 1 further comprising seal means carried on said running tool between said running tool and one of said inner and outer bodies and movable along one of said inner and outer bodies to positioning thereabove whereby said positioning causes pressure variance indication to reflect disengagement of said running tool from said inner and outer bodies, and fluid transmission means within said seal means to prevent a pressure differential across said seal means.

29. The apparatus of claim 1 wherein said setting means carried on said running tool includes a slotted member; carriage means initially selectively engaged to said slotted member for travel within said slotted member upon manipulation of said running tool to shift one of said inner and outer longitudinally extending bodies with respect to the other of said inner and outer longitudinally extending bodies to anchor said liner to said casing; a radially extending annular pressure chamber open to the interior of said running tool; a piston member sealably mounted to said running tool and within said chamber and responsive to selectively disengage said carriage means; and means for selectively entrapping fluid within said apparatus.

30. The apparatus of claim 29 wherein said slotted member comprises: a first position for securing said carriage member during initial longitudinal movement of said apparatus within said well bore; a second position for housing said carriage in response to subsequent longitudinal movement of one of said inner and outer bodies; a third position for housing said carriage upon rotation of said running tool; and fourth sleeve position for housing said carriage upon further subsequent longitudinal movement of said running tool.

31. The apparatus of claim 29 wherein said slotted member comprises: a first position for housing said carriage means during initial longitudinal running of said apparatus within said well bore; a second position for housing said carriage means in response to subsequent movement of one of said inner and outer bodies; a third position for housing said carriage means upon rotation of said running tool; a fourth sleeve position for housing said carriage means upon further subsequent longitudinal movement of said running tool; and means in said slotted member for automatic alignment of said carriage means with one of said positions to permit said carriage means to be housed within said aligned position upon further and subsequent longitudinal movement of said apparatus to permit said apparatus to be subsequently longitudinally moved within said well.

32. An apparatus for running, setting and anchoring a liner in a well bore casing, said apparatus being connectable to a tubular member extendible thereabove to the top of the well, said apparatus comprising: a longitudinally shiftable tubular body; expander means caarried by said tubular body; lower connection means on said tubular body for connecting the tubular body to a linera therebelow; sleeve means mounted on said tubular body and operably associatable with said tubular body upon longitudinal shifting of said tubular body with respect to said sleeve means; gripping means carried on said sleeve means engagable by said expander means and movable outwardly into gripping engagement with said well bore casing; drag means slidable longitudinally along said casing for resisting longitudinal travel of said apparatus while in said well bore with sufficient frictional force to support the weight of one of said tubular body and said sleeve means therebelow; and setting means responsive to at least one of fluid pressure and mechanical manipulation, said setting means including slot means and carriage means initially selectively engaged to said slot means for travel within said slot means to shift said longitudinally shiftable tubular body with respect to said sleeve means to anchor said liner in said well bore and on said casing, said setting means further comprising a radially extending annular piston chamber, a piston element in said chamber responsive to selectively disengage said carriage means, and means for selective entrapment of fluid pressure within said apparatus.

33. A method of running, setting and anchoring a liner in a well bore casing, comprising the steps of: (1) inserting within said well bore an apparatus connectible to a tubular member extendible to the top of the well thereof, said apparatus comprising: an inner longitudinally extending body; an outer longitudinally extending body around said inner body; connecting means on one of said inner and outer bodies for connection of a liner therebelow; expander means carried on one of said inner and outer bodies; gripping means carried on the other of said inner and outer bodies and engagable with said expander means whereby said gripping means are shifted into gripping engagement with said casing; a manipulatable tubular running tool releasably secured to said inner and outer bodies; drag means mounted on said running tool slidable longitudinally along said casing; means for selective disengagement of said running tool from said inner and outer bodies; and setting means responsive to each of fluid pressure and mechanical manipulation and carried on said running tool to longitudinally shift one of said inner and outer bodies with respect to the other of said inner and outer bodies to anchor said liner to said casing, said drag means resisting longitudinal travel of said apparatus while in said well bore with sufficient frictional force to support the weight of one of said inner and outer bodies therebelow and to afford operation of said setting means during response to mechanical manipulation, said setting means including a slotted member; carriage means initially selectively engaged to said slotted member for travel within said slotted member upon manipulation of said running tool to shift one of said inner and outer longitudinally extending bodies with respect to the other of said inner and outer longitudinally extending bodies to anchor said liner to said casing; a radially extending annular pressure chamber open to the interior of said running tool; a piston member sealably mounted to said running tool and within said chamber and responsive to selectively disengage said carriage means; and means for selectively entrapping fluid within said apparatus; (2) running said apparatus in said well to a positionable depth within said well bore adjacent said casing; (3) applying pressure within said apparatus to activate said setting means to cause said carriage means to travel in said slot means to position for anchoring said liner within said well bore and on said casing and for shifting said longitudinally shiftable tubular body upwardly with respect to said sleeve means to cause said expander means carried by said tubular body to engage said gripping means carried on said sleeve means and move said gripping means outwardly into gripping engagement with said well bore casing; and (4) rotating said tubular member extendible to the top of the well to release said tubular running tool from said longitudinally shiftable body for subsequent retrieval of said running tool out of said well bore.

34. A method of running, setting and anchoring a liner in a well bore casing, comprising the steps of: (1) inserting within said well bore an apparatus connectible to a tubular member extendible to the top of the well thereof, said apparatus comprising: an inner longitudinally extending body; an outer longitudinally extending body around said inner body; connecting means on one of said inner and outer bodies for connection of a liner therebelow; expander means carried on one of said inner and outer bodies; gripping means carried on the other of said inner and outer bodies and engagable with said expander means whereby said gripping means are shifted into gripping engagement with said casing; a manipulatable tubular running tool releasably secured to said inner and outer bodies; drag means mounted on said running tool slidable longitudinally along said casing; means for selective disengagement of said running tool from said inner and outer bodies; and setting means responsive to at least one of fluid pressure and mechanical manipulation and carried on said running tool to longitudinally shift one of said inner and outer bodies with respect to the other of said inner and outer bodies to anchor said liner to said casing, said drag means resisting longitudinal travel of said apparatus while in said well bore with sufficient frictional force to support the weight of one of said inner and outer bodies therebelow and to afford operation of said setting means during response to mechanical manipulation, said setting means including a slotted member; carriage means initially selectively engaged to said slotted member for travel within said slotted member upon manipulation of said running tool to shift one of said inner and outer longitudinally extending bodies with respect to the other of said inner and outer longitudinally extending bodies to anchor said liner to said casing; a radially extending annular pressure chamber open to the interior of said running tool; a piston member sealably mounted to said running tool and within said chamber and responsive to selectively disengage said carriage means; and means for selectively entrapping fluid within said apparatus; (2) running said apparatus in said well to a positionable depth within said well bore adjacent said casing; (3) applying pressure within said apparatus to activate said setting means to cause said carriage means to travel in said slot means to position for anchoring said liner within said well bore and on said casing and for shifting said longitudinally shiftable tubular body upwardly with respect to said sleeve means to cause said expander means carried by said tubular body to engage said gripping means carried on said sleeve means and move said gripping means outwardly into gripping engagement with said well bore casing; and (4) rotating said tubular member extendible to the top of the well to release said tubular running tool from said longitudinally shiftable body for subsequent retrieval of said running tool out of said well bore.

35. A method of running, setting and anchoring a liner in a well bore casing, comprising the steps of: (1) inserting within said well bore an apparatus connectible to a tubular member extendible to the top of the well thereof, said apparatus comprising: an inner longitudinally extending body; an outer longitudinally extending body around said inner body; connecting means on one of said inner and outer bodies for connection of a liner therebelow; expander means carried on one of said inner and outer bodies; gripping means carried on the other of said inner and outer bodies and engagable with said expander means whereby said gripping means are shifted into gripping engagement with said casing; a manipulatable tubular running tool releasably secured to said inner and outer bodies; drag means mounted on said running tool slidable longitudinally along said casing; means for selective disengagement of said running tool from said inner and outer bodies; and setting means responsive to at least one of fluid pressure and mechanical manipulation and carried on said running tool to longitudinally shift one of said inner and outer bodies with respect to the other of said inner and outer bodies to anchor said liner to said casing, said drag means resisting longitudinal travel of said apparatus while in said well bore with sufficient frictional force to support the weight of one of said inner and outer bodies therebelow and to afford operation of said setting means during response to mechanical manipulation, said setting means including a slotted memmber; carriage means initially selectively engaged to said slotted member for travel within said slotted member upon manipulation of said running tool to shift one of said inner and outer longitudinally extending bodies with respect to the other of said inner and outer longitudinally extending bodies to anchor said liner to said casing; a radially extending annular pressure chamber open to the interior of said running tool; a piston member sealably mounted to said running tool and within said chamber and responsive to selectively disengage said carriage means; and means for selectively entrapping fluid within said apparatus; (2) running said apparatus in said well to a positionable depth within said well bore adjacent said casing; (3) applying pressure within said apparatus to activate said setting means to cause said carriage means to travel in said slot means to position for anchoring said liner within said well bore and on said casing and for shifting said longitudinally shiftable tubular body upwardly with respect to said sleeve means to cause said expander means carried by said tubular body to engage said gripping means carried on said sleeve means and move said gripping means outwardly into gripping engagement with said well bore casing; (4) rotating said tubular member extendible to the top of the well to release said tubular running tool from said longitudinally shiftable body for subsequent retrieval of said running tool out of said well bore; and (5) injecting within said tubular member extendible to the top of the well a cement slurry pumpable through said tubular member, said apparatus and said liner, for subsequent setting in said well bore between said well bore and said liner to affix said liner in said well bore.

36. A method of running, setting and anchoring a liner in a well bore casing, comprising the steps of: (1) inserting within said well bore an apparatus connectible to a tubular member extendible to the top of the well thereof, said apparatus comprising: a longitudinally shiftable tubular body; expander means carried by said tubular body; lower connection means on said tubular body for connecting the tubular body to a liner therebelow; sleeve means mounted on said tubular body and operably associatable with said tubular body upon longitudinal shifting of said tubular body with respect to said sleeve means; gripping means carried on said sleeve means engagable by said expander means and movable outwardly into gripping engagement with said well bore casing; drag means slidable longitudinally along said casing for resisting longitudinal travel of said apparatus while in said well bore with sufficient frictional force to support the weight of one of said tubular body and said sleeve means therebelow; and setting means responsive to at least one of fluid pressure and mechanical manipulation, said setting means including slot means and carriage means initially selectively engaged to said slotted member for travel within said slot means to shift said longitudinally shiftable tubular body with respect to said sleeve means to anchor said liner in said well bore and on said casing, said setting means further comprising a radially extending annular piston chamber, and a piston element in said chamber responsive to selectively disengage said carriage means, and means for selective entrapment of fluid within said apparatus; (2) running said apparatus in said well to a positionable depth within said well bore adjacent said casing; (3) applying pressure within said apparatus to activate said setting means to cause said carriage means to travel in said slot means to position for anchoring said liner within said well bore and on said casing and for shifting said longitudinally shiftable tubular body upwardly with respect to said sleeve means to cause said expander means carried by said tubular body to engage said gripping means carried on said sleeve means and move said gripping means outwardly into gripping engagement with said well bore casing; (4) rotating said tubular member extendible to the top of the well to release said tubular running tool from said longitudinally shiftable body for subsequent retrieval of said running tool out of said well bore; and (5) discharge of said pressure contained in said apparatus through said means for selective entrapment of fluid within said apparatus.

37. A method of running, setting and anchoring a liner in a well bore casing, comprising the steps of: (1) inserting within said well bore and apparatus connectible to a tubular member extendible to the top of the well thereof, said apparatus comprising: a longitudinally shiftable tubular body; expander means carried by said tubular body; lower connection means on said tubular body for connecting the tubular body to a liner therebelow; sleeve means mounted on said tubular body and operably associatable with said tubular body upon longitudinal shifting of said tubular body with respect to said sleeve means; gripping means carried on said sleeve means engagable by said expander means and movable outwardly into gripping engagement with said well bore casing; drag means slidable longitudinally along said casing for resisting longitudinal travel of said apparatus while in said well bore with sufficient frictional force to support the weight of one of said tubular body and said sleeve means therebelow; and setting means responsive to at least one of fluid pressure and mechanical manipulation, said setting means including slot means and carriage means initially selectively engaged to said slotted member for travel within said slot means to shift said longitudinally shiftable tubular body with respect to said sleeve means to anchor said liner in said well bore and on said casing, said setting means further comprising a radially extending annular piston chamber, and a piston element in said chamber responsive to selectively disengage said carriage means, and means for selective entrapment of fluid within said apparatus; (2) running said apparatus in said well to a positionable depth within said well bore adjacent said casing; (3) applying pressure within said apparatus to activate said setting means to cause said carriage means to travel in said slot means to position for anchoring said liner within said well bore and on said casing and for shifting said longitudinally shiftable tubular body upwardly with respect to said sleeve means to cause said expander means carried by said tubular body to engage said gripping means carried on said sleeve means and move said gripping means outwardly into gripping engagement with said well bore casing; (4) rotating said tubular member extendible to the top of the well to release said tubular running tool from said longitudinally shiftable body for subsequent retrieval of said running tool out of said well bore; (5) discharge of said pressure contained in said apparatus through said means for selective entrapment of fluid within said apparatus; and (6) injecting within said tubular member extendible to the top of the well a cement slurry pumpable through said tubular member, said apparatus and said liner, for subsequent setting in said well bore between said well bore and said liner to affix said liner in said well bore.

38. A running tool for setting a liner hanger in a well bore by one of hydraulic and mechanical means, said liner hanger having inner and outer longitudinally extending bodies, one of said bodies being shiftable longitudinally by said running tool with respect to the other of said bodies, said running tool being selectively engagable to said bodies, said running tool comprising: drag means mounted on the exterior of said running tool and circumferentially extending therearound for resisting longitudinal travel of said liner hanger while in said well bore with sufficient frictional force to support the weight of one of said inner and outer bodies therebelow during mechanical manipulagtion; setting means carried on said running tool responsive to manipulation of said running tool during one of hydraulic and mechanical activation thereof to longitudinally shift one of said inner and outer bodies to anchor said liner hanger in said well, said drag means affording operation of said setting means during mechanical activation of said running tool; releasing means operable between said running tool and said inner and outer bodies for selective disengagement of said running tool from said bodies; slot and carriage means included within said setting means initially selectively engaged to said slot means for travel within said slot means to shift said longitudinally shiftable tubular body with respect to said sleeve means to anchor said liner in said well bore and on said casing, said setting means further comprising a radially extending annular piston chamber, and a piston element in said chamber responsive to selectively disengage said carriage means.

* * * * *